US012709876B2

(12) United States Patent
Ferretti

(10) Patent No.: US 12,709,876 B2
(45) Date of Patent: Aug. 18, 2026

(54) CONTROL PROCESS FOR REDUCING WATER WASTE IN WATER HEATING SYSTEMS, CORRESPONDING CONTROL DEVICE AND RECIRCULATION VALVE

(71) Applicant: Cristiano Gazzalle Ferretti, Curitiba (BR)

(72) Inventor: Cristiano Gazzalle Ferretti, Curitiba (BR)

( * ) Notice: Subject to any disclaimer, the term of this patent is extended or adjusted under 35 U.S.C. 154(b) by 292 days.

(21) Appl. No.: 18/708,812

(22) PCT Filed: Nov. 9, 2022

(86) PCT No.: PCT/BR2022/050430
§ 371 (c)(1),
(2) Date: May 9, 2024

(87) PCT Pub. No.: WO2023/081989
PCT Pub. Date: May 19, 2023

(65) Prior Publication Data

US 2025/0019942 A1 Jan. 16, 2025

(30) Foreign Application Priority Data

Nov. 12, 2021 (BR) ..... 1020210227885
Nov. 7, 2022 (BR) ..... 1020220226466

(51) Int. Cl.
*E03B 7/07* (2006.01)

(52) U.S. Cl.
CPC ..... *E03B 7/071* (2013.01); *E03B 7/075* (2013.01)

(58) Field of Classification Search
CPC ..... E03B 7/071
USPC ..... 700/282
See application file for complete search history.

(56) References Cited

U.S. PATENT DOCUMENTS 9,904,296 B2 * 2/2018 Peczalski ..... G05D 7/0635
2019/0316330 A1 * 10/2019 Abbing ..... E03B 7/075

* cited by examiner

*Primary Examiner* — Travis R Hunnings
(74) *Attorney, Agent, or Firm* — Intellectual Property Consulting, LLC; Jared Rovira

(57) ABSTRACT

This environmentally friendly invention refers to a control process for reducing water waste in hot water installations, carried out by a recirculation valve and/or a control device, through the control of water flow and its direction according to temperature, with application at any point of consumption with hot water available, with the purpose of avoiding waste by recirculating cold or unheated water at the desired temperature existing in the water pipe between the consumption and heating points, with the advantage of being completely mechanical, without requiring any electrical installation or dedicated hydraulic installation.

9 Claims, 10 Drawing Sheets

CONTROL PROCESS FOR REDUCING WATER WASTE IN WATER HEATING SYSTEMS, CORRESPONDING CONTROL DEVICE AND RECIRCULATION VALVE

This environmentally friendly invention refers to a control process for reducing water waste in hot water installations, carried out by a recirculation valve and/or a control device, through the control of water flow and its direction according to temperature, with application at any point of consumption with hot water available, with the purpose of avoiding waste by recirculating cold or unheated water at the desired temperature existing in the water pipe between the consumption and heating points, with the advantage of being completely mechanical, without requiring any electrical installation or dedicated hydraulic installation.

As it is known from technical resources in the field of water heating systems used to supply hot water to showers and taps, specifically those where the heating point is far from the point of consumption, there is a waiting time for the water to reach the desired temperature and this water, while not properly heated, is completely wasted. This is repeated every time enough time passes between closing the tap and opening it again for the water in the hot water pipe to cool down.

Making conservative estimates based on the population in colder Brazilian regions, around 80 million people, the number of residences is approximately 20 million and, of these, considering that only 20% use a system where the heating point is far from the heating point. of use (e.g. gas or solar), there are approximately 4 million homes. If there are 2 purges per day in each one and, on average, 5 liters of water are wasted each time the water is expected to reach the desired temperature, then approximately 40,000 $m^3$ of potable water per day are wasted in the country, due to the purge of the water from the hot water pipes of homes. This value may be higher for Brazil, as the estimates are conservative, and will certainly be much higher if we consider other countries.

To overcome this problem, there are currently two methods used to reduce the waste of unheated water at the unwanted temperature:

1*a*) The first method involves a reservoir for the temporary accumulation of unused unheated water at the desired temperature, where the water is taken to be heated again until it reaches the desired temperature or reused in another way; and 1*b*) The second method uses a forced recirculation pipe of unused unheated water at the desired temperature, using a hydraulic pump and a dedicated recirculation pipe, with the return of unheated water at the desired temperature to the heating point.

Such processes have the disadvantage of using electronic systems for sensing and/or controlling the hydraulic pump, requiring at least one electrical power point, which may be close to the point of consumption, as well as requiring the installation of additional piping, which implies in additional costs, and/or reservoirs that, in addition to costs, also require space to be positioned.

Brazilian patent BR1020150153210, entitled "Hydraulic set with reservoir installed in a gas heating shower, for water reuse system", revealed a system developed to prevent cold water, initially accumulated in the bathroom pipes, from being discarded by the user after opening of the shower through a pump working with a mixing tube connected to the piping of a shower with heater, in which the cold water in the piping is collected and released into the water tank, simultaneously with the introduction of hot water into the mixing tube. This revealed set presents the inconvenience of using an electrical system with timer and hydraulic pump to control the supply of hot water at the point of consumption and the disadvantage of using two auxiliary reservoirs and float switches to control the operation of the hydraulic pump and safety against overflows in the event of an electrical failure of the hydraulic pump.

Brazilian patent BR1020160296730 entitled "Improvements introduced in a diverter register for water reuse integrated into a hydraulic shower installation or related" revealed a diverter register for water reuse integrated into a hydraulic shower installation or related with an electric, gas or solar water heating system, with the diverter valve being mounted on the shower hydraulic installation piping, specifically between the mixer set and the heated water outlet shower piping, in order to divert the cold drinking water contained in the hydraulic installation to another hydraulic installation, such as hydraulic plumbs for buildings or similar, with the body of the diverter valve being integrally embedded in the masonry of bathrooms or similar. This diverter valve has the disadvantage that the user must empirically determine the necessary time for hot water with the desired temperature to be available in the pipes, and then activate the diverter valve handle, so that this properly heated water is delivered to the shower. It also has the disadvantage of requiring skilled labor to install the diverter valve on the bathroom wall and its connection with the existing shower supply pipe and the building's plumb line, in addition to the fact that, on its own, the invention does not guarantee that the pressure of hot water will be greater than that of cold water, which is mandatory for it to work.

Brazilian patent BR1020130339911 entitled "Passive valve for reducing water waste from a heating system through recirculation" revealed a passive valve for circulating water from a heating system, with passive automatic closing by thermal actuation, with the main objective to eliminate cold water contained in the hot water pipe, directing it to the cold water reservoir. The release of the water flow passage is carried out manually by the user, and the flow is closed automatically through a thermal system. The arrival of hot water at the valve heats a thermal fluid that expands and displaces a piston, releasing an internal assembly to return the valve to the closed position, ceasing the flow of water. The water that was contained in the hot water piping is directed to the cold water reservoir, taking advantage of the existing piping and the difference in level between the reservoirs.

This revealed valve has the drawbacks of needing to have its parts designed and sized specifically for the flow and pressure conditions of each application where it is used, and also needing the user to remember to activate it before using the consumption point, as it is installed in a different location.

Patent US2015075631 entitled "Temperature-activated cold water diversion valve" revealed a valve that directs cold or unheated water at the desired temperature to a user-defined reservoir, which can be installed, for example, on a sink counter basin, and uses a single water flow stream through an internal pipe around a thermally sensitive coil that transmits rotation for automatic closing of a valve upon arrival of heated water to the valve and after closing, the valve resets itself to the next activation and use. The disclosed system has the disadvantage of requiring an additional reservoir chosen by the user to divert cold water or water at a temperature below the desired temperature and, like other patents already mentioned, it is a valve installed in addition to the one already existing at the point of use, making water savings dependent on user action.

The control process for reducing water waste in water heating systems, corresponding control device and recirculation valve, object of the present invention, was developed to overcome the disadvantages, limitations and inconveniences encountered in systems for reducing waste of unheated water at the desired temperature currently used in water heating systems, through the use of a control device which can be inside a recirculation valve or in the user's tap, with commands to open and close the water flow, whether hot, cold or at an intermediate temperature, and to activate the recirculation system, with the advantage of being completely mechanical, without requiring any electrical installation or dedicated hydraulic installation.

The following technical problems that currently exist and the way the present invention resolved are:

2*a*) Current technologies use dedicated piping to redirect cold or unheated water to the desired temperature, requiring physical modification of the hydraulic installation, resulting in additional costs in new installations or renovation of existing installations. This is solved by the present invention by a control device and/or a valve that does not require dedicated piping, bringing the technical improvements of being able to be installed to replace the existing hot water valve or tap and without any modification to the aesthetics of the location;

2*b*) Current technologies work with some type of electrical or electronic temperature control and/or pump drive that moves the water for recirculation until it reaches the desired temperature at the point of use. This is solved by the present invention by a fully mechanical valve, bringing the technical improvement of dispensing with the installation of electrical wiring and the use of timers, solenoid valves, control units, buttons, presence sensors, among others; and

2*c*) Current technologies use different mechanisms or equipment, one to control the normal flow of water and the other to control the recirculation of unheated water at the desired temperature. This is solved by the present invention by a unique control device, which brings the technical improvement of working with commands to open and close the water flow, whether hot, cold or at an intermediate temperature, and to activate the recirculation system.

The control process for reducing water waste in water heating systems, corresponding control device and recirculation valve, objects of the present invention, represent the final result of the inventor's development, after his unsuccessful search for a product that was capable of avoiding the waste of water purged from the hot water pipe that was easy to use and install, and that was capable of recirculating water as long as necessary, automatically serving the user only the water that was already heated. For application in sinks with two taps, one for hot water and the other for cold water, the inventor then modified a commercial thermostatic valve, which is designed as an anti-scalding safety device mixing very hot water with cold water to obtain water at the desired temperature according to a setting, so that it works in reverse, now to separate hot water from cold water, using this valve adapted under a sink. The inventor was already aware that the commercial valve contained, among other components, check valves, which, due to previous studies, were known to be necessary, but in the modified valve they were used in the opposite direction, allowing the water to only leave the valve, when in the original commercial version the retentions only allow water to enter the connections for hot and cold water. The modified valve had its inlet port (previously, it was the mixed water outlet) connected to the outlet of the sink's hot water tap, the cold water port was connected to the cold water pipe, and the hot water port was connected to the hot water inlet of the sink mixer, which was previously connected to the hot water tap outlet. The idea was that, when opening the tap, the water would be directed to the cold water pipe while it was not yet heated, and would only come out of the sink spout when it was hot. After installation and, when trying to use it for the first time, the inventor proved the theory that the pressure of the hot water pipe needs to be greater than that of the cold water pipe, due to the fact that recirculation did not start spontaneously after opening the faucet. It was necessary for the inventor to manually activate the pressurizer of his property's heating system so that the water began to recirculate. Once this was done, the rest of the process happened as expected, so that the water came out of the sink spout only when it was heated. Also as expected, it was proven that, once recirculation was carried out and the water in the pipe was still hot, the tap worked normally, without the need to start recirculation again, so that only hot water always came out of the tap spout. As the sink was very close to the shower, the inventor realized that he could use his installation made in the bathroom sink to recirculate the water from the hot water pipes throughout the bathroom, including the shower, as, by doing so, the water from the shower also came out hot, with no waste. There was still one problem to be resolved: the presence of two valves, one for opening and closing the hot water flow and another, a modified thermostatic one, with retainers, for directing it according to the water temperature. That was when the inventor developed a unique valve, with the ability to control the flow of water and, at the same time, initiate recirculation, directing the water that had not yet been heated through the cold water pipe and the hot water to the hot water inlet of the mixer. As it was observed that shower water could be recirculated through the sink, in the initial inventive process a valve was developed with the appropriate shape and dimensions so that it could be installed to replace the sink's original hot water tap, as it is a much easier assembly to be installed, so that the greatest number of parts from the original installation could be reused, including all the finishing parts of the tap, so that, once installed, the valve would not cause any aesthetic changes to the sink. In a second inventive process, however, even knowing the greater difficulty in installation, the inventor also developed a version to be installed in showers or bathtubs, which could be embedded in the masonry, in the case of a new construction or bathroom renovation planned by other reasons. The development of a second base option for the installation was necessary due to the great difference in the positions of the tap axis and hydraulic connections between the installation under a sink and the one built into the wall, however the concept of a modular product line was defined, because the set of components that controls the flow and direction of water, the control device, can be used in both applications, in shower and sink bases. The thread system with pin locks between the control device shaft and the shaft adapters and was designed so that the same control device can be used on any base, adapting to different heights of tap handles. The slots at the ends of the shaft adapters were designed to enable the assembly of the handle that the user will have from its original installation. The base lids and the bases are designed to jointly hold the control device and shaft adapters in the correct position, direct water flow correctly, and enable assembly of both the entire assembly in place and other components from the original installation.

In a third inventive process, a control device was created for application in types of taps known as single-lever taps, in which only one handle can be raised and lowered to open and close the water flow, and also rotated to regulate the proportion of taps. hot and cold water available. In this type of faucet, the commercially established construction concept is a piece known as a "cartridge", which has market standard dimensions, functioning within a normally metallic part that makes up the body of the faucet. The cartridge is a part with plastic components, with a very low cost when compared to the complete faucet and is commercially available as a replacement part among faucet manufacturers. Therefore, the control device for single-lever faucets was designed so that it can be installed to replace the original cartridge, at a much reduced cost, to maintain the user's original faucet.

As an alternative, new lid and housing models were developed, without threads, which fit together by interference, facilitating assembly.

For a better understanding of the control device and recirculation valve of the present invention, the following figures are attached:

FIG. 1, which shows the connection diagram for the recirculation valve (VR) of the present invention, to serve a point of consumption (PC);

FIG. 2, which shows a schematic diagram with the component parts of the recirculation valve (VR) of the present invention;

FIG. 3, which shows the block diagram itemized with the steps of the control process for reducing water waste in water heating systems of the present invention;

FIG. 4, which shows the exploded perspective view of the components of the control device (DC) of the present invention;

FIG. 5, which shows the top perspective view of the lid (T) of the control device (DC) of the present invention;

FIG. 6, which shows the bottom view and the bottom perspective view of the lid (T) with the detail of the fitting of the locking ring (AT) of the control device (DC) of the present invention;

FIG. 7, which shows the top perspective view, at the top of the figure, and the bottom perspective view, at the bottom of the figure, of the axis (E) of the control device (DC) of the present invention;

FIG. 8, which shows the top perspective view, at the top of the figure, and the bottom perspective view, at the bottom of the figure, of the guide (G) of the control device (DC) of the present invention;

FIG. 9, which shows the top perspective view of the seat (AS) of the control device (DC) of the present invention;

FIG. 10, which shows the top perspective view of the temperature sensing device (EC) of the control device (DC) of the present invention;

FIG. 11, which shows the top perspective view, at the top of the figure, and the bottom perspective view, at the bottom of the figure, of the plunger (EB) of the control device (DC) of the present invention;

FIG. 12, which shows the lower perspective view, in the upper part of the figure, and the upper perspective view, in the lower part of the figure, of the housing (C) of the control device (DC) of the present invention;

FIG. 13, which shows the top perspective view and the longitudinal sectional view of the assembly of the temperature sensing device (EC) with the plunger (EB) of the control device (DC) of the present invention;

FIG. 14, which shows the top perspective view and the longitudinal sectional view of the assembly of the suitable elastic means (M) in the housing (C) of the control device (DC) of the present invention;

FIG. 15, which shows the top perspective view and the longitudinal sectional view of the housing assembly (C), with the appropriate elastic means (M), the plunger (EB) and the temperature sensing device (EC) of the device control (DC) of the present invention;

FIG. 16, which shows the front view of the shaft assembly (E) with the shaft seal ring (OE) of the control device (DC) of the present invention;

FIG. 17, which shows the top perspective view and the longitudinal sectional view of the shaft assembly (E) with the shaft seal ring (OE) and the guide (G) of the control device (DC) of the present invention;

FIG. 18, which shows the fixation of the guide sealing ring (OG) on the guide (G) of the control device (DC) of the present invention;

FIG. 19, which shows the bottom view, and the bottom perspective view of the lid assembly (T), with the guide (G), with the shaft (E) and with the locking ring (AT) of the control device (DC) of the present invention;

FIG. 20, which shows the bottom perspective view of the fixation of the lid (OT) and base (OB) sealing rings in the assembly with the lid (T), the guide (G) and the shaft (E) of the device. control (DC) of the present invention;

FIG. 21, which shows the bottom perspective view and sectional view of the seat assembly (AS) on the lid (T) of the control device (DC) of the present invention;

FIG. 22, which shows the longitudinal sectional view of the complete assembly of the control device (DC) of the present invention;

FIG. 23, which shows the longitudinal section view in the operation of the control device (DC) of the present invention, in the closed condition and without water flow;

FIG. 24, which shows the longitudinal sectional view of the operation of the control device (DC) of the present invention, in the condition of an open tap and with a flow of cold or unheated water at the desired temperature (AF);

FIG. 25, which shows the longitudinal sectional view of the operation of the control device (DC) of the present invention, in the condition of pressurization of the hot water pipe with the activation of the shaft (E) by the user;

FIG. 26, which shows the longitudinal sectional view of the operation of the control device (DC) of the present invention, in the condition of pressurized passage of the hot water flow (AQ) by actuation of the force pin (P) of the sensor device temperature (EC);

FIG. 27, which shows the exploded perspective view with the main components of the recirculation valve (VR) of the present invention in the configuration for a consumption point in which the main axis of the control device (DC) is vertical;

FIG. 28, showing the top perspective view of the sink base lid (TBP) of the recirculation valve (VR) of the present invention;

FIG. 29, which shows the top perspective view of the shaft adapter (AE) for the recirculation valve (VR) control device (DC) of the present invention in the configuration for a consumption point in which the main shaft of the control device (DC) is vertical;

FIG. 30, which shows the top perspective view and the left side view of the sink base (BP) of the recirculation valve (VR) of the present invention;

FIG. 31, which shows the top perspective view and the right side view of the sink base (BP) of the recirculation valve (VR) of the present invention;

FIG. 32, which shows the top perspective view of the recirculation valve (VR) assembly of the present invention for the configuration for a point of consumption in which the main axis of the control device (DC) is vertical;

FIG. 33, which shows the connection diagram of the component elements of a standard water heating system and their interconnections with the recirculation valve (VR) of the present invention, to serve a consumption point (PC) in which the main axis of the control device (DC) is horizontal;

FIG. 34, which shows the exploded perspective view with the main components of the recirculation valve (VR) of the present invention in the configuration for a consumption point in which the main axis of the control device (DC) is horizontal;

FIG. 35, which shows the top perspective view of the shower base lid (TBC) of the recirculation valve (VR) of the present invention;

FIG. 36, showing the side perspective view of the shower shaft adapter (ACE) of the recirculation valve (VR) control device (DC) of the present invention;

FIG. 37, which shows the exploded perspective view with the main components of the shower tray (BC) of the recirculation valve (VR) of the present invention;

FIG. 38, which shows the left side perspective view of the shower tray (BC) of the recirculation valve (VR) of the present invention;

FIG. 39, which shows the right side perspective view of the shower tray (BC) of the recirculation valve (VR) of the present invention;

FIG. 40, which shows the lower side perspective view of the shower tray (BC) of the recirculation valve (VR) of the present invention;

FIG. 41, showing the front right perspective view of the recirculation valve (VR) with the shower base assembly (BC) with the shower base lid (TBC) and the shower shaft adapter (ACE) of the present invention;

FIG. 42, which shows the top and bottom perspective view of the alternative housing (CA);

FIG. 43, which shows the top and bottom perspective view of the alternative lid (TA);

FIG. 44, which shows the top perspective view of the fit between the alternative lid (TA) and the alternative housing (CA);

FIG. 45, which shows the top perspective view of the alternative housing (CA) and sealing rings (OC-1), (OC-2) and (OC-3);

FIG. 46, which shows the exploded view of the single-lever control device (DCM);

FIG. 47, which shows the top and bottom perspective view of the single-lever housing (CM);

FIG. 48, which shows the top and bottom perspective view of the lever support (SA);

FIG. 49, which shows the top and bottom perspective view of the lever (AL);

FIG. 50, which shows the top perspective view of the guide wire (AG);

FIG. 51, which shows the top perspective view of the lever fitting (AL) with the guide wire (AG);

FIG. 52, which shows the top and bottom perspective view of the limit switch (FC);

FIG. 53, which shows the top and bottom perspective view of the clip washer (ARP);

FIG. 54, which shows the top and bottom perspective view of the director (DIR);

FIG. 55, which shows the top perspective view of the single-lever spacer washer (ARE);

FIG. 56, which shows the bottom perspective view and top view of the divider (DIV);

FIG. 57, which shows the perspective view of the divider (DIV) and the divider sealing ring (OVD);

FIG. 58, which shows the top view of the seal (VED);

FIG. 59, which shows the top perspective view of the single-lever base (BA);

FIG. 60, which shows the bottom perspective view of the single-lever base (BA);

FIG. 61, which shows the top perspective view of the divider (DIV), seal (VED) and single-lever base (BA); and FIG. 62, which shows the bottom perspective view of the lever (AL), lever support (SA) and guide wire (AG).

In the control process for reducing the waste of unheated water at the desired temperature, in water heating systems, object of the present invention, the function of the hot water inlet valve is incorporated in the recirculation valve (VR), as shown in FIG. 1, which has the following functions:

3*a*) Control of the water flow, from the hot water pipe (TAQ), which contains the heater (AQA), to the point of consumption (PC), whether hot, cold or at an intermediate temperature;

3*b*) Directing the water flow according to the temperature, through thermostatic control, to the point of consumption (PC), so that it is served only with water at the desired temperature;

3*c*) Recirculation of unheated water at the desired temperature, directing it, through thermostatic control, to the water recirculation line (LRA) which is connected to the cold water piping (TAF), which will occur due to the pressure difference caused by the pressurization pump (BMB) present in the hot water piping (TAQ); and

3*d*) Blocking the direct flow of cold water, from the cold water pipe (TAF) to the point of consumption (PC).

The recirculation valve (VR), whose diagram is shown in FIG. 2, is equipped with a control device (DC), an installation base (B), and a cold water outlet check valve (VAF). The control device (DC) has commands to control the water flow and to activate the water recirculation system. The installation base (B) with different construction configurations according to the position, shape and dimensions of the consumption point (PC) to be served.

The control process for reducing water waste in water heating systems, carried out by the recirculation valve (VR), object of the present invention patent, as shown in FIG. 3, has the following sequence of operations:

4*a*) The user starts the hot water flow at the consumption point (PC) by opening the recirculation valve (VR);

4*b*) If the water available in the hot water pipe (TAQ) is already at the desired temperature, the process goes to item (4*f*) and, otherwise, the valve activates the recirculation of unheated water at the desired temperature;

4*c*) Water not heated to the desired temperature, which comes from the hot water piping (TAQ), is directed, by thermostatic control and due to the pressure difference, to the cold water piping (TAF), whose flow is controlled by the valve recirculation valve (VR) and, if the user completely closes the recirculation valve (VR), the process goes to item (4*g*);

4*d*) As long as the water temperature in the hot water pipe (TAQ) is lower than desired, the recirculation valve (VR) maintains its flow directed towards recirculation;

4*e*) With the water at the desired temperature, the recirculation valve (VR) directs, through thermostatic control, the flow of hot water to the consumption point (PC), automatically ending the recirculation of water to the cold water pipe;

4*f*) With the water at the desired temperature, the flow of hot water, from the hot water pipe (TAQ) to the consumption point (PC), is controlled by moving the recirculation valve (VR); and

4*g*) The user ends the water flow at the point of consumption (PC) by closing the recirculation valve (VR).

The present invention is not limited to the constructive details and assemblies described and illustrated in this document, as it can be adapted to different formats and be applied in various ways within the scope of the claims. Some terms, such as "horizontal" and "vertical" are used only to help understand the applicability of the invention. The terminology presented is used to describe the invention, not to be used as a limitation.

The recirculation valve (VR) can incorporate the function of the mixer (MX) and also a single-lever type valve, where the mixer (MX) and the hot water valve with the cold water valve (RAF) form a single piece.

According to FIGS. 4 to 12, the control device (DC) of the recirculation valve (VR) is provided with a lid (T), a lid sealing ring (OT), a sealing ring for the base (OB), a shaft (E), a shaft seal ring (OE), a guide (G), a guide seal ring (OG), a locking ring (AT), of a seat (AS), of a temperature sensing device (EC) with a force pin (P), of a plunger (EB), of a suitable elastic medium (M), of a housing (C), of a upper housing sealing ring (OC-1) and a lower housing sealing ring (OC-2).

The lid (T), hollow, cylindrical in shape, equipped with a lid hole (OTE), circular in shape, through and aligned with the central segment of the shaft (ECC) of the shaft (E), and being the lower part of the lid (TI) with a smaller diameter than the top part of the lid (TS), with internal vertical channels for fitting the upper part of the seat (ASS), and with an internal channel for fitting the locking ring (AT), in a U shape.

The shaft (E), with the upper shaft segment (ES), cylindrical in shape, threaded and with the shaft through hole (OPE), with the central shaft segment (ECC), cylindrical, hollow and with a slightly larger diameter than the diameter of the upper shaft segment (ES), with the ringed shaft segment (EA), hollow, ring-shaped, around the central shaft segment (ECC), with a lateral channel (CLE), for fixation of the shaft sealing ring (OE), of the o-ring type, and aligned with the guide hole (OGE), and with the lower segment of the shaft (EI), hollow and of prismatic shape with a hexagonal section to fit the guide (G).

The guide (G), hollow, cylindrical in shape, staggered into an upper guide part (GS) and a lower guide part (GI), with the upper guide part (GS) having an outer circular channel (ROG), for fixing the guide sealing ring (OG), of the o-ring type, and a guide hole (OGE), through, cylindrical in shape and aligned with the ring segment of the shaft (EA), and with the part lower part of the guide (GI) with a smaller diameter than that of the upper part (GS), externally threaded on the left, for threaded fitting with the upper part of the seat (ASS) and equipped with internal longitudinal channels for fitting the shaft (E).

The seat (AS), hollow, stepped into a seat upper part (ASS) and a seat lower part (ASI), the seat upper part (ASS) externally of prismatic shape of hexagonal section, fitted into the lower part of the lid (TI), internally circular in shape, internally threaded on the left to thread the lower part of the guide (GI), and the lower part of the seat (ASI) in a cylindrical shape of small thickness.

The temperature sensing device (EC) with the force pin (P), metallic, cylindrical in shape, aligned with the piston hole (OEB) and internally fitted to the lower segment of the shaft (EI).

The plunger (EB), with the outer part (PEB), made of rubber or similar, in the shape of a ring and with sealing protrusions (SEB) around the center of the outer face, and with the inner part (IEB), metallic, of small thickness cylindrical shape, with the piston hole (OEB), through, circular in shape and aligned with the temperature sensing device (EC) and with the through holes (OPEB), circular, of small diameter and distributed radially.

The suitable elastic means (M) is fitted to the bottom of the housing (CI) and the bottom of the piston (EB).

The housing (C), hollow and of small thickness, with the upper part of the housing (CS), cylindrical in shape, with internal thread for fixing the lower part of the lid (TI), with the upper external side channel (RC-1), for fitting the upper housing sealing ring (OC-1), of the o-ring type, with the lower external side channel (RC-2), for fitting the lower housing sealing ring (OC-2), o-ring type, with lower water flow holes (OIC) and upper water flow holes (OSC), through, circular, radially arranged and distributed on the lateral surface, and with the lower part of the housing (CI), hollow, prismatic in shape with a hexagonal section on the outside and circular on the inside.

FIGS. 13 to 22 show the control device (DC) assembly process, which takes place in the following sequence of operations:

5*a*) The temperature sensing device (EC) with the force pin (P) is fitted into the plunger hole (OEB), with the force pin (P) facing upwards;

5*b*) The appropriate elastic medium (M) is placed inside the housing (C);

5*c*) The temperature sensing device (EC) with the force pin (P) and the plunger (EB) are placed on the appropriate elastic medium (M) inside the housing (C);

5*d*) The shaft sealing ring (OE) is fixed in the side channel (CLE) of the shaft ring segment (EA);

5*e*) The shaft (E) is assembled with the guide (G), with the lower segment of the shaft (EI) fitted into the channels in the lower part of the guide (GI);

5*f*) The guide sealing ring (OG) is fixed in the outer circular channel (ROG) of the guide (G);

5*g*) The assembly with the shaft (E) and guide (G) is fixed inside the lid (T) and secured with the locking ring (AT);

5*h*) The lid sealing ring (OT) is fixed between the top of the lid (TS) and the bottom of the lid (TI), and the base sealing ring (OB) is fixed in the outer side channel (ROT) of the lid (T);

5*i*) The seat (AS) is fixed to the guide (G) by the upper part of the seat (ASS) and fitted into the channels in the lower part of the lid (TI), with the internal threaded part of the upper seat (AS) being fitted with the external threaded part of the lower part of the guide (GI);

5*j*) The assembly with the temperature sensing device (EC), the force pin (P), the plunger (EB), the suitable elastic medium (M) and the housing (C), is joined with the assembly with the lid (T), the axis (E), the guide (G) and the seat (AS); and

5*k*) The housing sealing rings (OC-1) and (OC-2) are fixed in the two external side channels (RC-1) and (RC-2).

FIGS. 23 to 26 show the operating process of the control device (DC), which takes place in the following sequence of operations:

6*a*) With the recirculation valve (VR) in the closed position, there is no water flow from the hot water piping entering the lower part of the housing (CI) of the control device (DC), the guide (G) and the seat (AS) force the plunger (EB) onto the bottom of the upper part of the housing (CS), compressing the appropriate elastic medium (M);

6*b*) With the recirculation valve (VR) in the open position, the shaft (E), the temperature sensing device (EC) and the seat (AS) move, the appropriate elastic medium (M) expands and forces the piston (EB), still keeping it in contact with the seat (AS), preventing the flow of water from exiting through the upper water flow holes (OSC) of the housing (C) and the flow of cold or unheated water at the desired temperature (AF) enters through the lower part of the housing (C) and exits through the lower water flow holes (OIC) of the housing (C);

6*c*) With the tap open, the shaft (E) is activated, the temperature sensing device (EC) moves, the appropriate elastic medium (M) is compressed, the piston (EB) moves, touching the bottom of the housing (CS), moving away from the seat (AS), preventing the water flow from exiting through the lower water flow holes (OIC) of the housing (C), the flow of cold or unheated water at the desired temperature (AF) enters through the lower part of the housing (C) and exits through the upper water flow holes (OSC) of the housing (C) which are connected to the hot water consumption point and this flow drives the pressurization pump (BMB) of the water pipe hot (TQA);

6*d*) When the shaft (E) stops being driven, the appropriate elastic medium (M) expands, moving the piston (EB) and the temperature sensing device (EC), the piston (EB) moves away from the bottom of the housing (C), rests against the seat (AS), preventing the flow of water through the upper water flow holes (OSC) of the housing (C), and the flow of cold or unheated water at the desired temperature (AF), returns exiting through the lower water flow holes (OIC) of the housing (C), which are connected to the cold water pipe, with water recirculating through the cold water pipe, due to the difference in pressure between it and the hot water pipe;

6*e*) With the water at the desired temperature, the temperature sensing device (EC) forces the force pin (P) against the shaft (E), compressing the appropriate elastic medium (M) and making the plunger (EB) moving until contact the bottom of the housing (CI) and moving away from the seat (AS), blocking the flow of hot water through the lower water flow holes (OIC) and directing the flow of hot water through the upper water flow holes (OSC) of the carcass (C); and 6*f*) When the user closes the recirculation valve (VR), the axis (E) moves the guide (G) and the guide (G) makes the seat (AS) move until the lower part of the seat (ASI) touching the plunger (EB), ceasing water flows, returning the control device (DC) to the condition described in item (6*a*).

FIGS. 27 to 32 show the assembly of the recirculation valve (VR) in the configuration for a point of consumption whose mixer (MX) and the hot and cold tap registers (RAF) are mounted vertically, with the assembly of the control device (DC) and the necessary complementary parts.

In this configuration, the control device (DC) is inserted into a sink base (BP), the shaft (E) has its reach increased with the use of the shaft adapter (AE), which is threaded onto the shaft (E) and secured with locking pin (PT) and a sink base lid (TBP) completes the recirculation valve (VR) assembly.

The sink base lid (TBP) is hollow, cylindrical in shape, stepped into an externally threaded top sink lid (TBPS) and a bottom sink lid (TBPI), internally threaded and flush with the nozzle (BB) from the base to the sink (BP).

The shaft adapter (AE), with the upper segment (AES) in a cylindrical shape with grooves distributed radially on the external side, with the central segment (AEC) in a cylindrical shape and with the lower segment (AEI), with a diameter slightly larger than that of the central segment, threaded from the inside to fit the shaft (E) and with two lateral oblong holes (REI) for the locking pin (PT) to pass through.

The locking pin (PT), cylindrical in shape.

The sink base (BP), with a base body (CB), cylindrical in shape, hollow, of small thickness, which serves as a housing for mounting the control device (DC), with a nozzle (BB), threaded externally, and with three externally threaded connections and diameters compatible with standard commercial fittings, with the connections being a water inlet (RA), a hot water outlet (SQ) and a cold water outlet (SF), the hot water (SQ) and the cold water outlet (SF) positioned on opposite sides of the base body (CB) and at different levels in relation to the base of the base body (CB), the hot water outlet (SQ) in superior position in relation to the cold water outlet (SF), the hot water outlet (SQ), aligned with the upper water flow holes (OSC) of the housing (C), with a centralized hot water outlet hole (OQ) and the cold water outlet (SF), aligned with the lower water flow holes (OIC) of the housing (C), with a centralized cold water outlet hole (OF) and equipped with a pressure check cold water valve (VAF) of the snap type, or similar.

In this assembly, the sink base lid (TBP) allows the entire recirculation valve assembly (VR) to be fixed to the sink top (TMP) at the same height as the hot water valve and/or at the same height as the tap base and cold water (RAF), and the upper internal part of the sink base lid (TBP) also accepts the assembly of the castle nut (CT), which, in turn, is responsible for securing the tap canopy finishing with the canopy fastener, these last 3 components coming from the user's previous installation. The shaft adapter (AE) is screwed onto the shaft (E) of the control device (DC) until its end reaches the necessary height so that the hot water handle is at the same height as the cold water handle. The shaft adapter (AE) is held in position with the locking pin (PT). The hot water outlet (SQ) of the sink base (BP) is connected to the mixer (MX) and the cold water outlet (SF) of the sink base (BP) is connected to the cold water pipe (TAF). The water inlet (RA) of the sink base (BP) is connected to the hot water pipe (TAQ).

The base of the cold water tap (RAF) has the inlet connected to the cold water pipe (TAF), and the cold water outlet (SF) from the base to the sink (BP) through the recirculation connection (LRA).

The mixer output (MX) is connected to the consumption point (PC).

The hot water knob controls the flow of water to the mixer (MX) and allows rapid flow of cold or undesired water from the hot water piping (TAQ) to the point of consumption (PC), which may be required to connect the pressurization pump of the hot water hydraulic installation, according to items (6*c*) and (6*d*) above.

In this configuration, the control device (DC) is inserted into a shower base (BC) with a shower tray lid (TBC) and the shaft (E) has its reach increased by using the shower shaft adapter (ACE), which is threaded onto the shaft (E) and secured with the locking pin (PT).

The hollow shower base lid (TBC), with the hole of the shower base lid (OTBC) and staggered in a cylindrical shaped and externally threaded upper part of the shower base lid (TBCS) in a central part of the shower tray lid (TBCC), of prismatic shape, and in a lower part of the shower tray lid (TBCI), cylindrical in shape, externally threaded and aligned with the main body of the shower tray (CBC).

The shower shaft adapter (ACE), with the upper part (PAS) in a cylindrical shape with grooves distributed radially on the external side, with the central segment (PAC) in a cylindrical shape and with the lower segment (PAI), threaded from the inside and with side cavities (PAL) for the passage of the locking pin (PT).

The shower base (BC), with a cylindrical, hollow, internally threaded main body of the shower base (CBC), which serves as a housing for mounting the control device (DC), with a central body of the base (CCBC) with three connections for water pipes of diameters compatible with standard commercial fittings and arranged in a "T" shaped structure, one being a connection for the shower's hot water inlet (CEQ), internally threaded and with a hot water inlet through hole (OCEQ), a shower hot water outlet connection (CSQ), externally threaded and with a hot water outlet through hole (OCSQ), and a recirculating cold water outlet (SFB), with a through hole for the hot water outlet (OSFB), with a shower cold water check valve, snap type or similar, inserted into the recirculation cold water outlet (SFB).

As an alternative, a new housing model (CA) was developed, which does not have an internal thread, which makes assembly easier, and a new lid (TA) was developed, which is simpler and fits more easily to the housing (CA).

Figure 1:
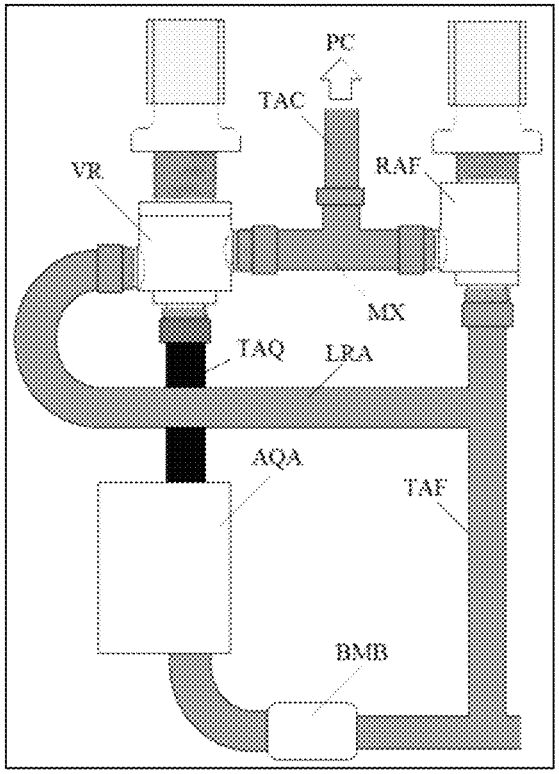
Figure 2:
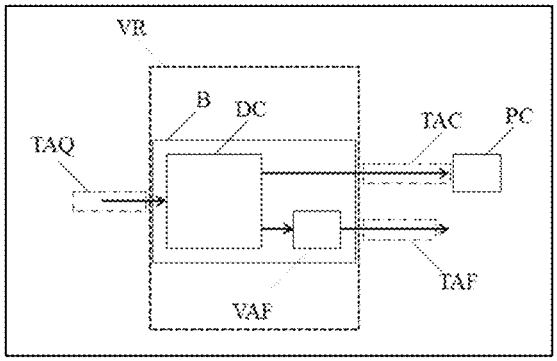
Figure 3:
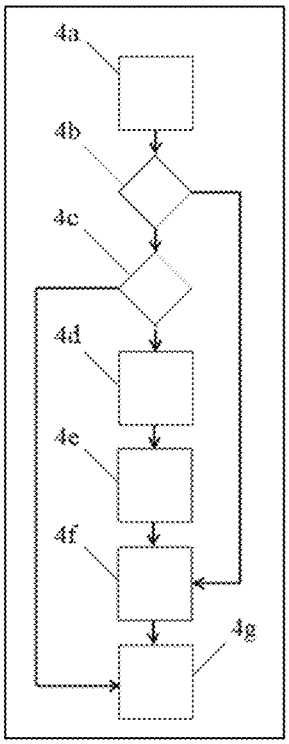
Figure 4:
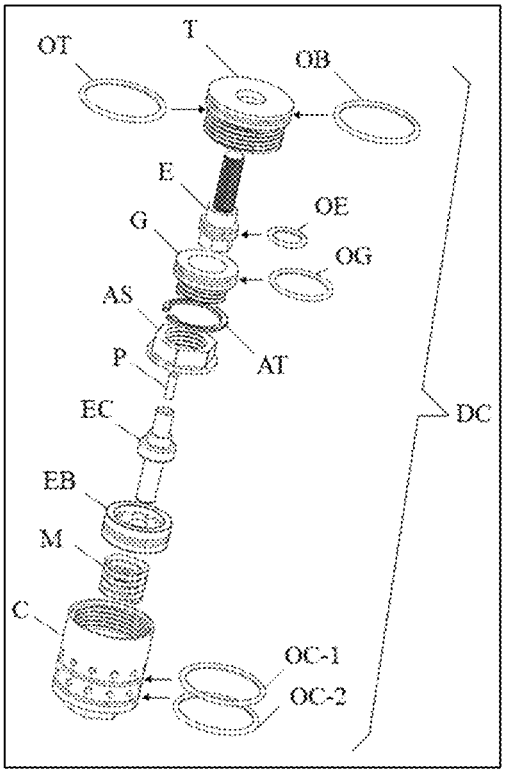
Figure 5:
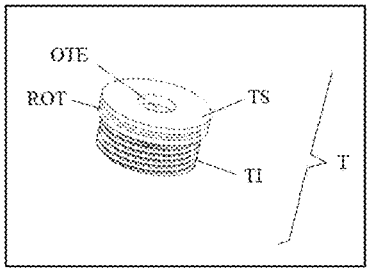
Figure 6:
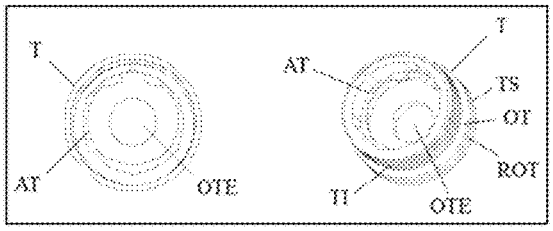
Figure 7:
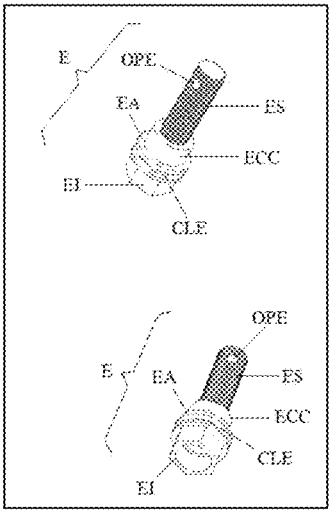
Figure 8:
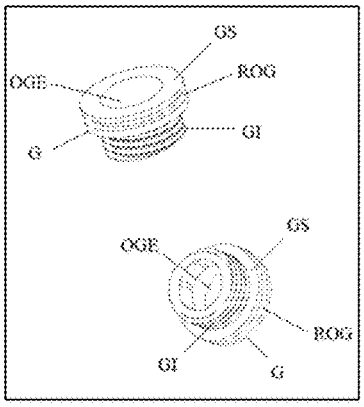
Figure 9:
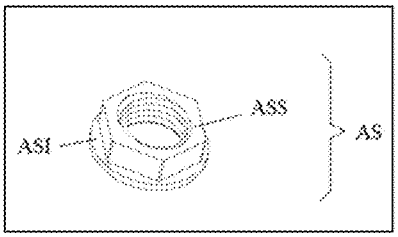
Figure 10:
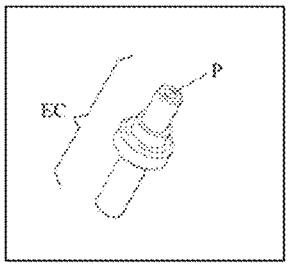
Figure 11:
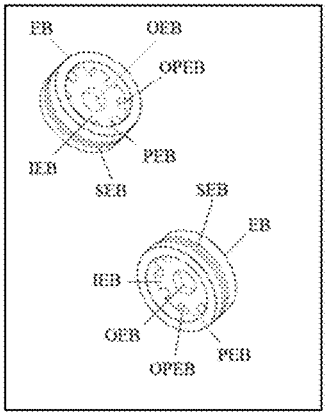
Figure 12:
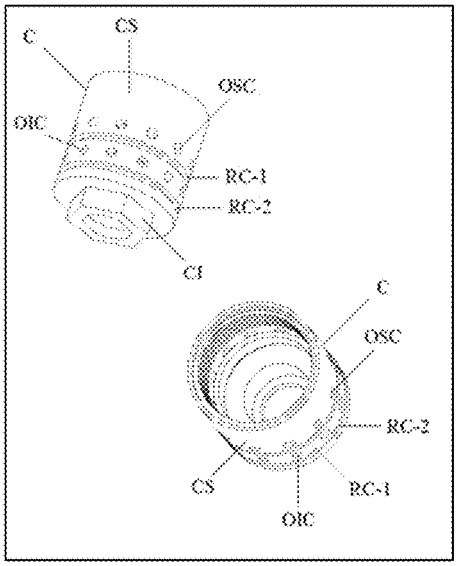
Figure 13:
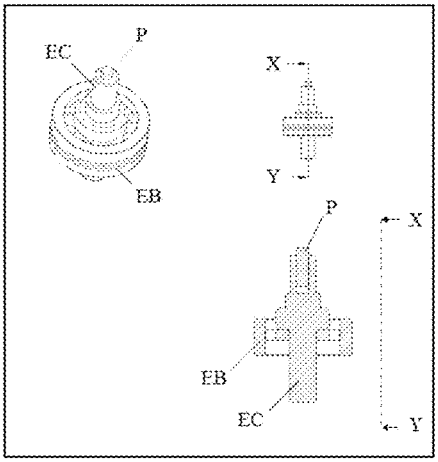
Figure 14:
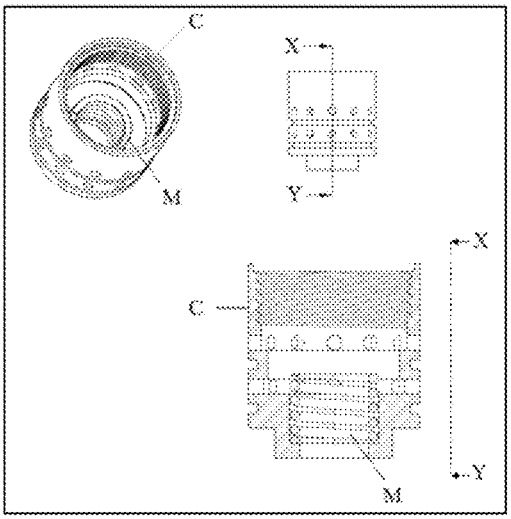
Figure 15:
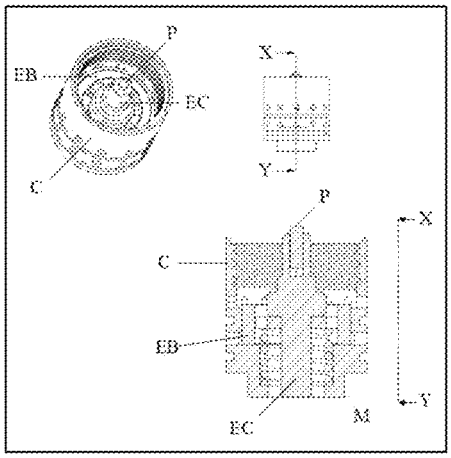
Figure 16:
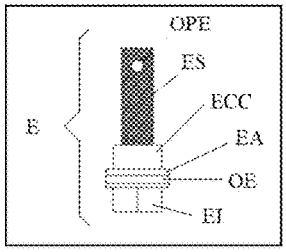
Figure 17:
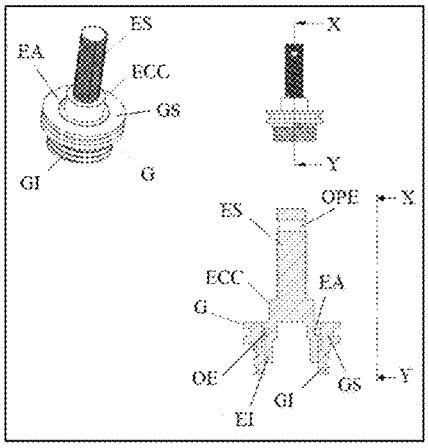
Figure 18:
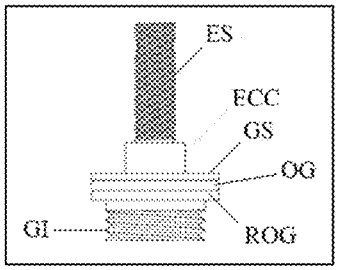
Figure 19:
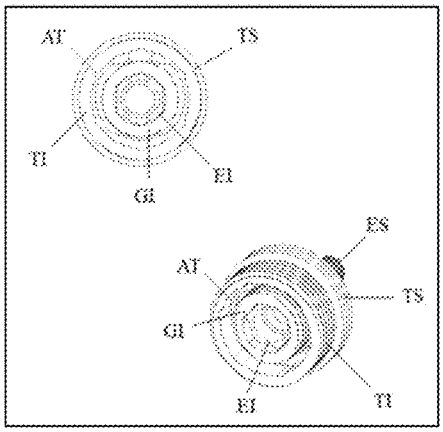
Figure 20:
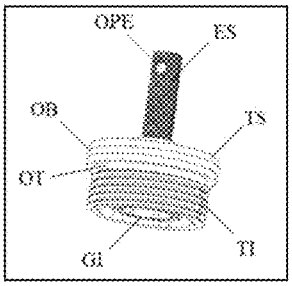
Figure 21:
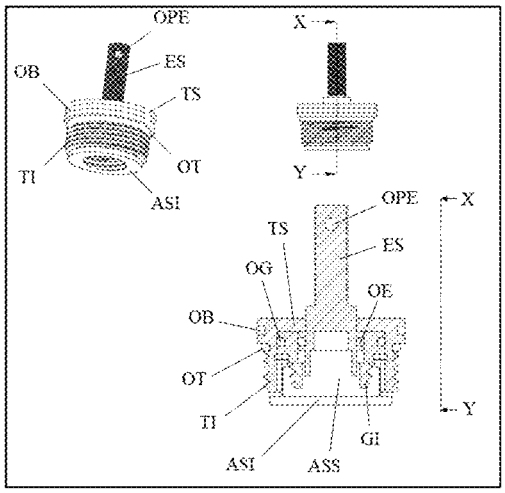
Figure 22:
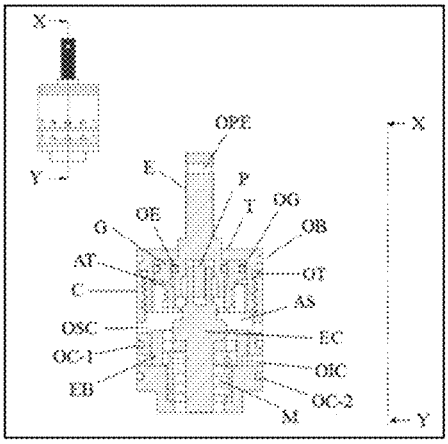
Figure 23:
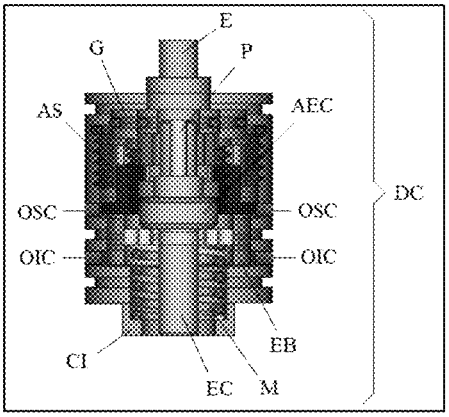
Figure 24:
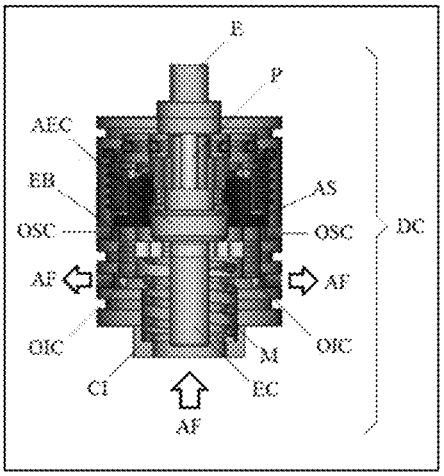
Figure 25:
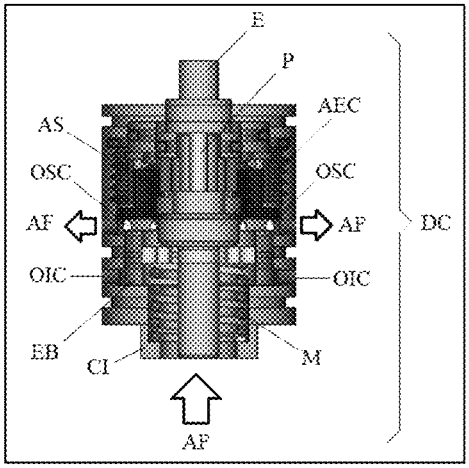
Figure 26:
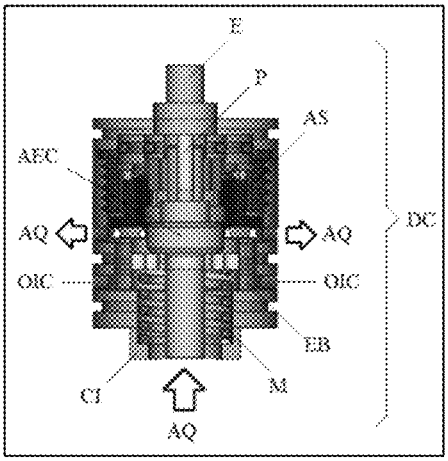
Figure 27:
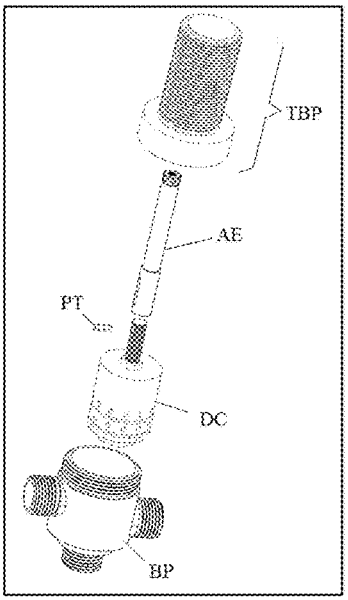
Figure 28:
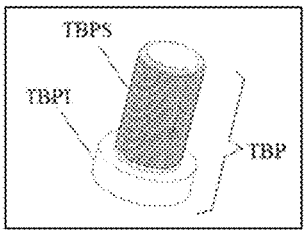
Figure 29:
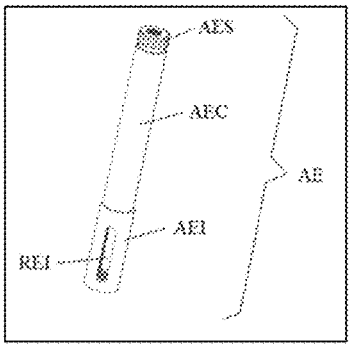
Figure 30:
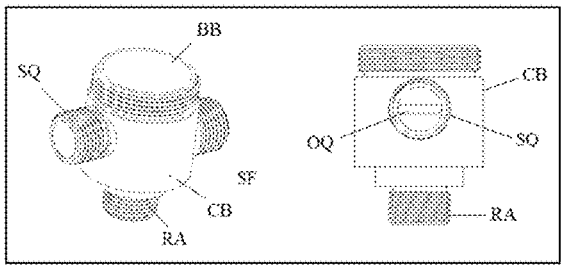
Figure 31:
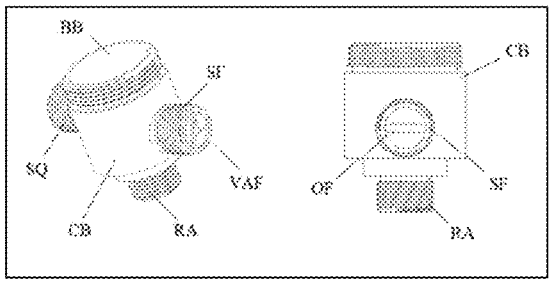
Figure 32:
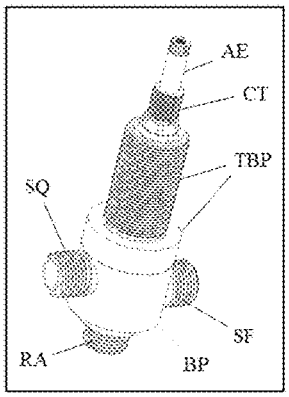
Figure 33:
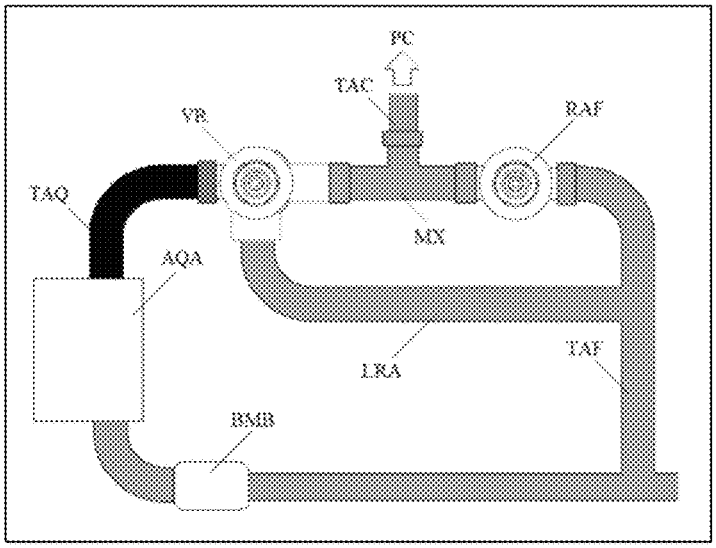
FIG. 33 shows the use of the recirculation valve (VR) replacing the hot water valve connected to the mixer (MX), with the recirculation connection (LRA) connected to the cold water pipe (TAF).
Figure 34:
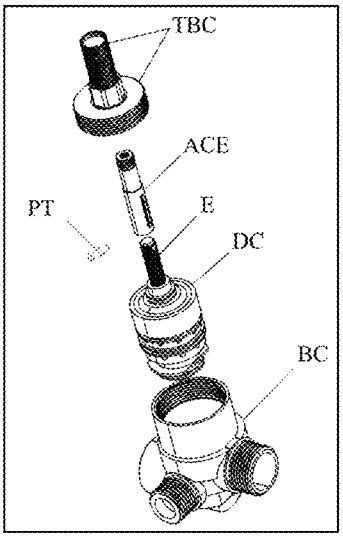
FIGS. 34 to 41 show the assembly of the recirculation valve (VR) in the configuration for a point of consumption whose mixer (MX) and the hot and cold tap registers (RAF) are assembled horizontally, with the assembly of the control device (DC) and the necessary complementary parts.
Figure 35:
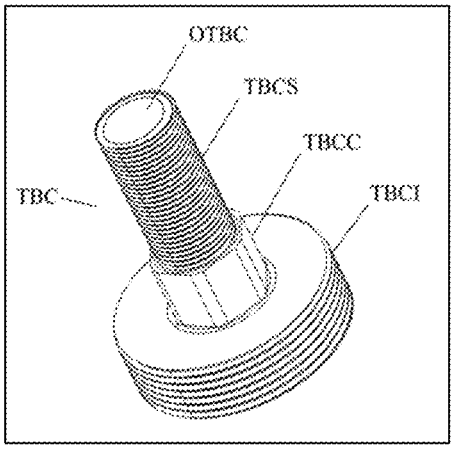
Figure 36:
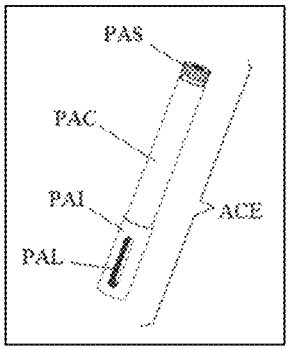
Figure 37:
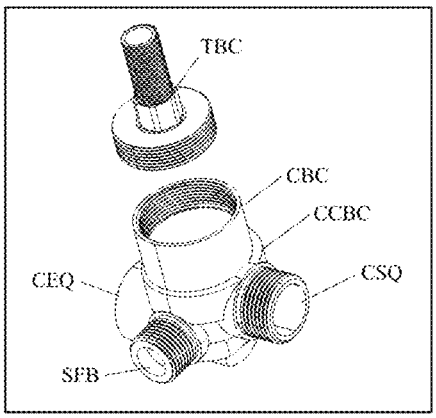
Figure 38:
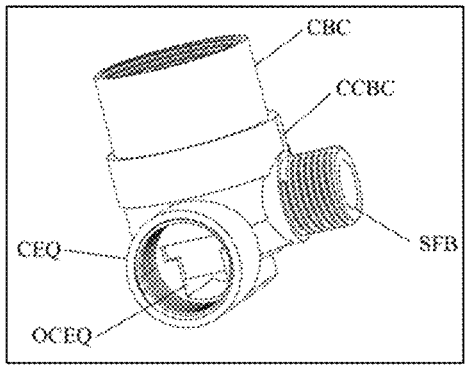
Figure 39:
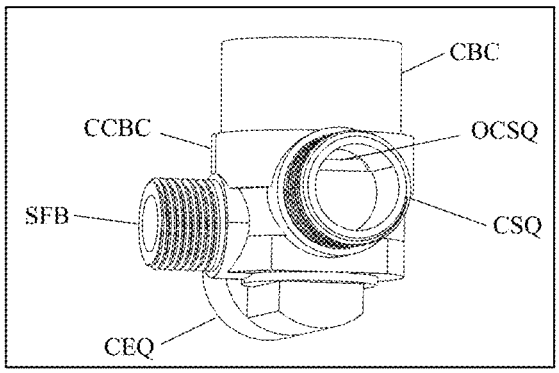
Figure 40:
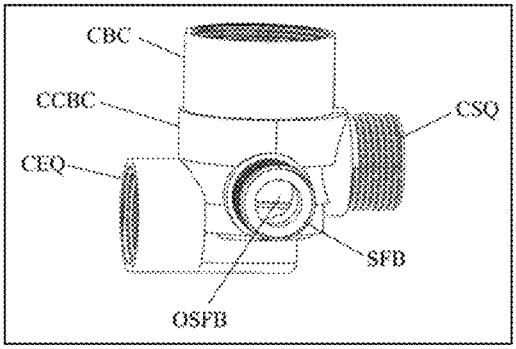
Figure 41:
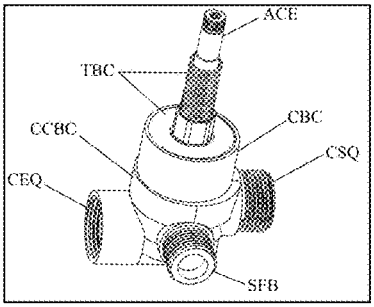
Figure 42:
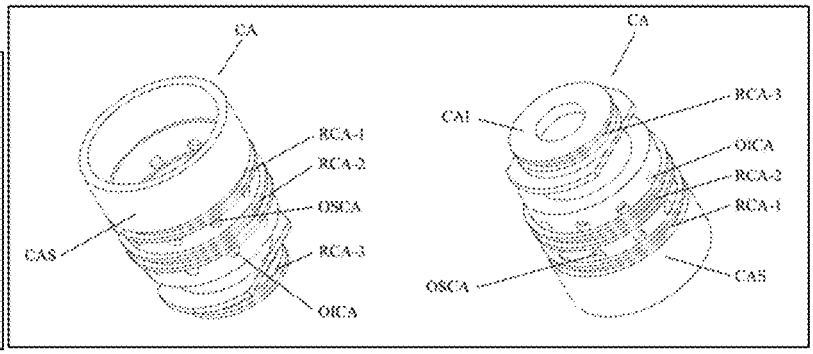

According to FIG. 42, the alternative housing (CA), hollow and thin, with the upper part of the housing (CAS), cylindrical in shape, with external side channels (RCA-1) and (RCA-2) for fitting the housing sealing rings (OC-1) and (OC-2) of the o-ring type, with lower water flow holes (OICA) and upper water flow holes (OSCA), passing, circular, radially arranged and distributed on the lateral surface, and with the lower part of the housing (CAI), hollow, with a prismatic shape on the outside and a circular shape on the inside, with the external side channel (RCA-3) for housing the o-ring housing sealing ring.

Figure 43:
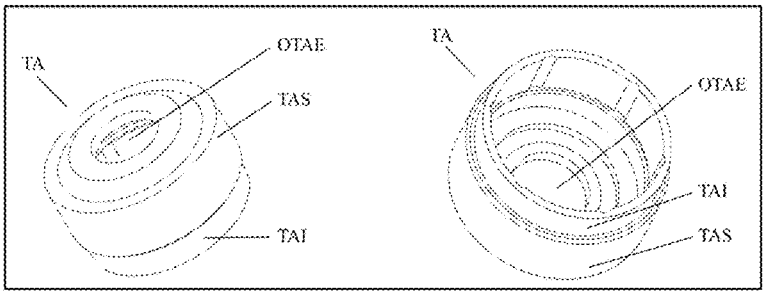
Figure 44:
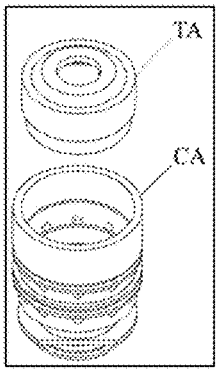
Figure 45:
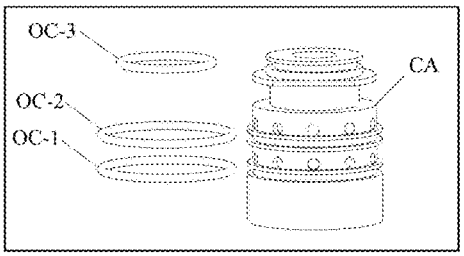
Figure 46:
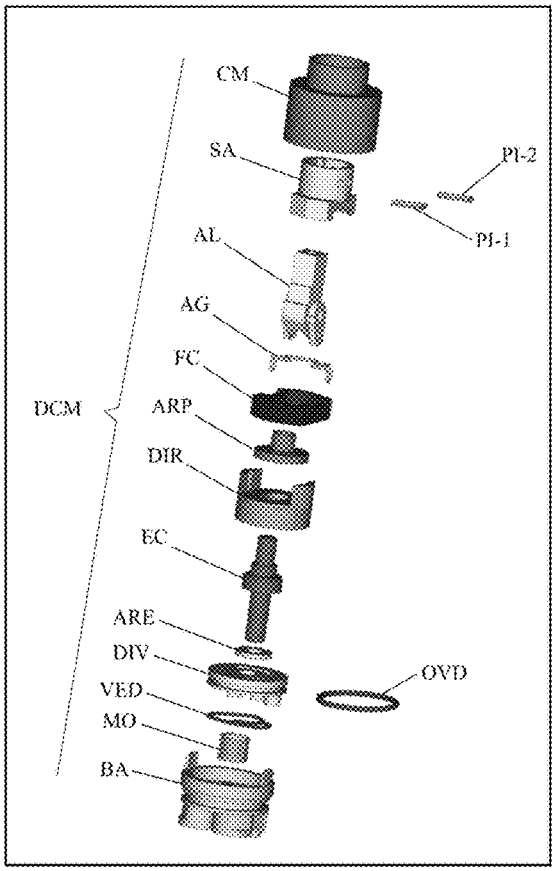
Figure 47:
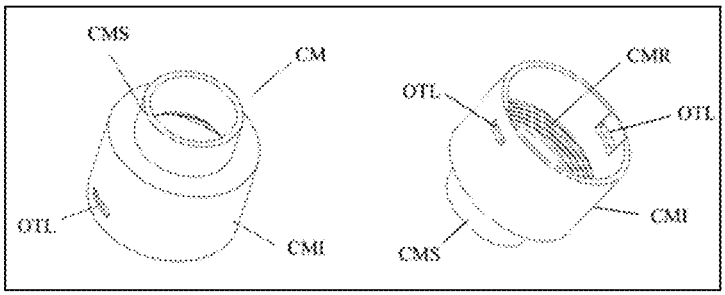
Figure 48:
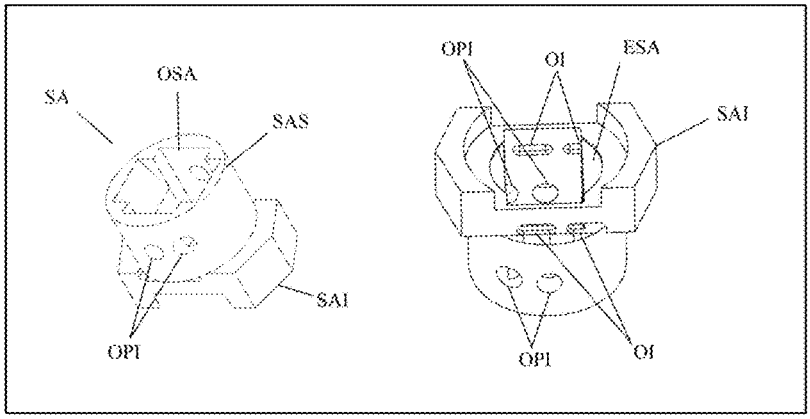
Figure 49:
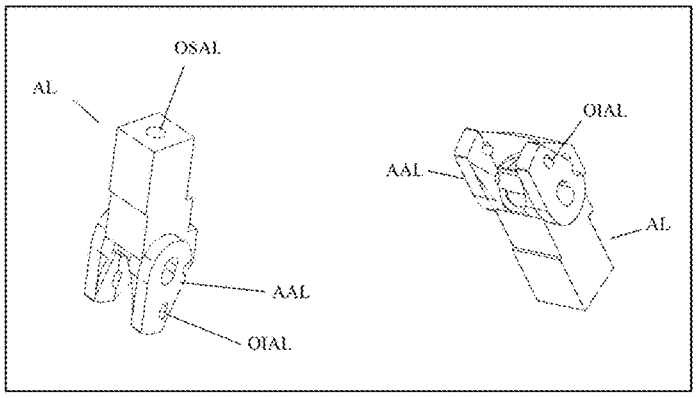
Figure 50:
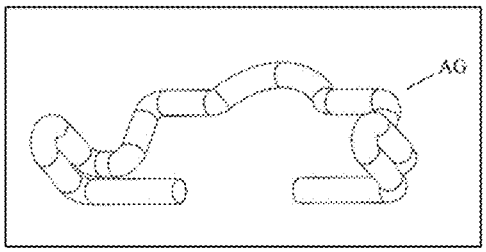
Figure 51:
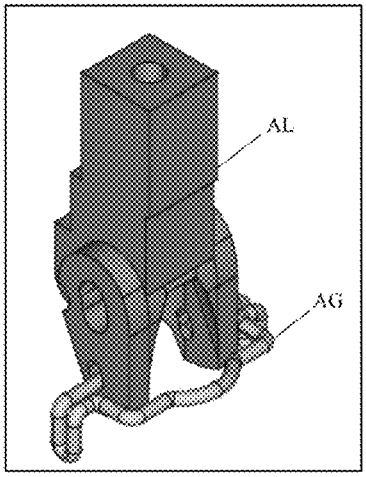
Figure 52:
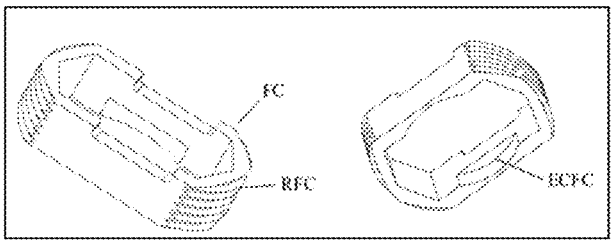
Figure 53:
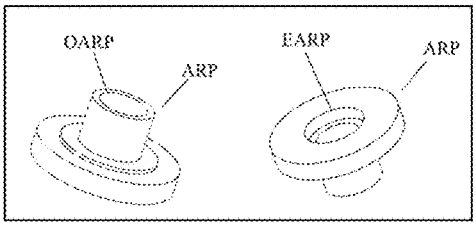
Figure 54:
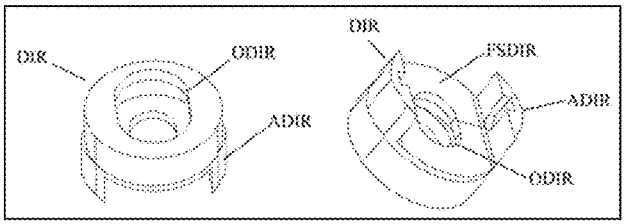
Figure 55:
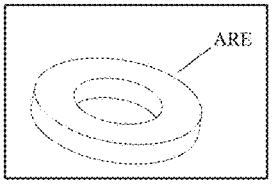
Figure 56:
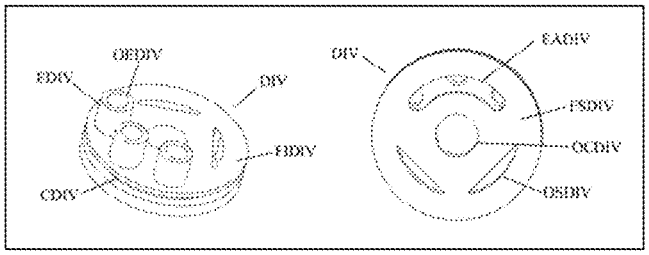
Figure 57:
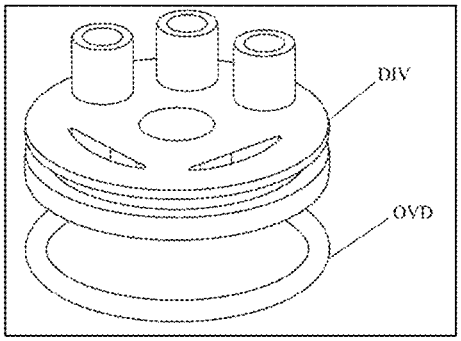
Figure 58:
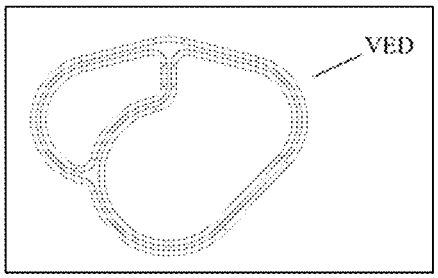
Figure 59:
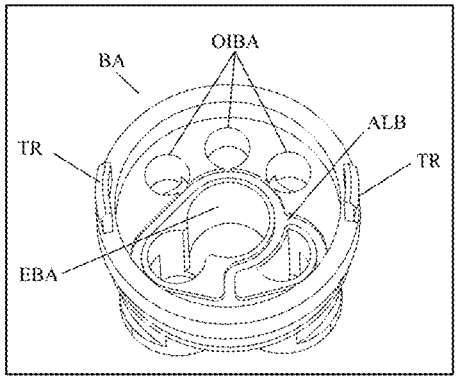
Figure 60:
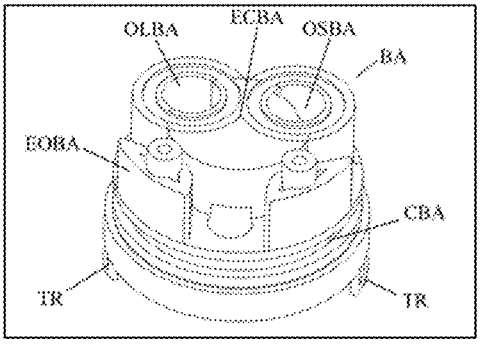
Figure 61:
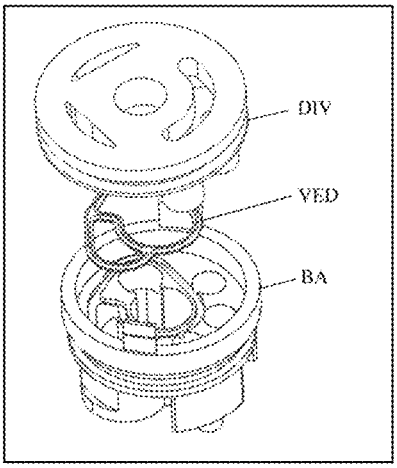

According to FIG. 43, the alternative lid (TA), hollow, cylindrical in shape, equipped with a lid hole (OTAE), circular through shape, which is aligned with the central segment of the shaft (ECC) of the shaft (E), and the lower part of the lid (TAI) is smaller in diameter than the upper part of the lid (TAS), with internal vertical channels for fitting the upper part of the seat (ASS), and with an internal channel for fitting the locking (AT), in C shape.

The alternative housing (CA) and alternative lid (TA) can replace the housing (C) and lid (T) during the installation process without necessary changes, and the operating process remains the same.

In order to also serve the different types of single-lever taps, a control device (DCM) was developed to reduce water waste for single-lever taps, which is equipped with a housing (CM), a lever support (SA), with two pins (PI-1) and (PI-2), a lever (AL), a guide wire (AG), a limit switch (FC), a clip washer (ARP), a guide (DIR), a temperature sensing device (EC) with a force pin (P), a spacer washer (ARE), a divider (DIV), a divider sealing ring (OVD), a sealing (VED), a suitable elastic medium (MO) and a base (BA).

The housing (CM) has a stepped cylindrical shape and has an upper part (CMS), cylindrical with a circular through hole, a lower part (CMI), cylindrical, hollow and with a diameter larger than the upper part (CMS), with an internal threaded section (CMR) and two locking holes (OTL), rectangular and with guide relief.

The lever support (SA) has a cylindrical upper part (SAS), with a cross-shaped hole (OSA) and four circular pin holes (OPI), two on each face concentric with each other, one part bottom (SAI), hexagonal in shape, with four oblong holes (OI) through, with an entrance (ESA), shaped like two staggered concentric circles and a rectangular passing hole on its lower face.

The lever (AL), with a stepped prismatic shape, has a hole (OSAL) on its upper face and has two flaps (AAL) on its lower part, each flap (AAL) contains a lower hole (OIAL) that positions and retains the wire guide (AG).

The limit switch (FC), shaped like an oblong section with a hexagonal central hole, has a thread (RFC) on its rounded external sides, has an inlet in both parallel straight sections of the upper face and has a circular inlet (ECFC) partial on its lower face.

The director (DIR), with a hollow cylindrical shape, has an oblong hole (ODIR) through it, has two semicircular tabs (ADIR) that allow the limit switch (FC) to be fitted, and has a smooth upper face (FSDIR) that sits the clip washer (ARP) connected to the temperature sensing device (EC).

The clip washer (ARP), has a stepped cylindrical shape with a central hole (OARP), circular passing hole and a central inlet (EARP) of larger diameter, on its lower face.

The divider (DIV), cylindrical in shape, has an upper face (FSDIV) that contains an oblong arched entrance (EADIV), contains a central hole (OCDIV) through and contains two sectioned holes (OSDIV), passing, in circular segment format; has a lower face (FIDIV) that contains three cylindrical elongations (EDIV) with a hole (OEDIV) inside that meets the arched entrance (EADIV) of the upper face (FSDIV); having a channel (CDIV) on its side for seating the divider sealing ring (OVD).

The base (BA), cylindrical in shape, has two extrusions (EOBA) with an "eye" shaped section, has an extrusion (ECBA), with a section shaped like two tangent circles with a semicircle in its lower part, which contains a through circular hole (OLBA) and contains a through hole (OSBA) in the shape of a "half-moon", has two locks (TR) opposite each other and has a channel (CBA) on its side; in its inner part, it has three through holes (OIBA), partially obstructed by the extrusions (EOBA) and (ECBA), which accommodate the cylindrical elongations (EDIV) of the divider (DIV), it has a central circular inlet (EBA), which accommodates the appropriate elastic medium (MO), and has a housing (ALB) that accommodates the seal (VED).

Figure 62:
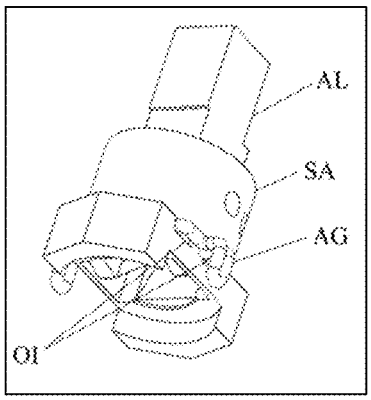

The process of assembling the control device for single-lever faucets follows the following sequence of operations:

9*a*) The lower part of the temperature sensing device (EC), with the force pin (P), is fitted and fixed in the hole in the spacer washer (OAR) and subsequently in the central hole of the divider (ODV), with the pin force (P) facing upward;

9*b*) The upper part of the temperature sensing device (EC) is fitted through the central hole of the director (ODR) and then fitted and fixed in the hole of the clip washer (OAP);

9*c*) The appropriate elastic medium (MO) is placed inside the central entry of the base (EBA);

9*d*) The seal (VED) is positioned in the base housing (ALB);

9*e*) The divider sealing ring (OVD) is fitted to the divider side channel (CDIV);

9*f*) The temperature sensing device (EC) with the force pin (P), the washer (ARE), the divider (DIV), the director (DIR) and the clip washer (ARP) are placed on the appropriate elastic medium (MO) inside the base (BA);

9*g*) The lever (AL) is fitted to the inside of the lever support (SA), being fixed by the pins (PI-1) and (PI-2);

9*h*) The guide wire (AG) is partially bent, positioned in the lower holes of the lever support (OI) coinciding with the lower holes of the lever (OIAL), and bent again to be positioned in the other holes (OI), as shown in the FIG. 62;

9*i*) The lever support (SA), together with the lever (AL) and the guide wire (AG), is fitted to the limit switch (FC), which is fitted to the internal cavity of the housing (CA); and

9*j*) The housing (CA), together with the lever (AL), lever support (SA), the pins (PI-1) and (PI-2), the guide wire (AG) and the limit switch (FC), is fixed to the base (BA), with the latches (TR-1) and (TR-2) fitted into the side locking holes (OTL-1) and (OTL-2), respectively.

The operation of the control device for single-lever taps follows the following steps:

10*a*) With the tap in the closed position, there is no flow of water from the hot and cold water pipes, connected to the bottom of the tap, towards the water outlet, as, within the control device (DCM), the director (DIR) and divider (DIV) are positioned so as not to allow water to pass through;

10*b*) With the tap in the open position and in the hot water position (handle raised and turned to the left), the director (DIR) moves in relation to the divider (DIV), making the interconnection between the inlet orifice (OLBA) hot water, the cold water inlet orifice (OSBA) and the water outlet orifice, however, if the water circulating through the control device (DCM) is not yet heated, the limit switch (FC) will be in the position upper part, the appropriate elastic means (MO), which is supported on the base (BA), presses the assembly consisting of the divider (DIV), spacer washer (ARE), temperature sensing device (EC), director (DIR) and clip washer (ARP) until the latter touches the lever (AL) and opens a space between the base (BA) and the divider (DIV), however, due to the shape in the lower region and the decentralized position in relation to the main axis of the pin (PI-1), the lever is forced back to the closed position (tap handle lowered), thus preventing cold water from leaving the tap but at the same time recirculating the water from the hot water pipe into cold water direction, due to the space between the divider (DIV) and the base (BA);

10*c*) With the tap in the hot water position (handle turned to the left) and recirculation taking place, when the water circulating through the control device (DCM) heats up, the power pin (P) of the temperature sensing device (EC), which is against the pin (PI-2), presses the assembly composed of the divider (DIV), spacer washer (ARE), temperature sensing device (EC), director (DIR) and clip washer (ARP) until the divider (DIV) touches the base (BA), resting on the divider sealing ring (OVD), ending recirculation and allowing the lever to be moved to open the tap (handle remains in the raised position), due to the space created between the lever (AL) and the clip washer (ARP); and

10*d*) If the tap moves to the cold water position (handle turned to the right), regardless of the temperature of the water circulating in the control device (DCM), the limit switch (FC) moves the assembly formed by the divider (DIV), spacer washer (ARE), temperature sensing device (EC), director (DIR) and clip washer (ARP) until the divider (DIV) touches the base (BA), with seating on the divider sealing ring (OVD), ending recirculation and allowing cold water to flow out of the tap if it is open (handle raised).

The invention claimed is:

1. Water recirculation valve control device of the control process for reducing water waste in water heating systems, characterized by being provided with a lid (T), a lid sealing ring (OT), a base seal ring (OB), of a shaft (E), a shaft seal ring (OE), a guide (G), a guide seal ring (OG), a locking device (AT), a seat (AS), a temperature sensing device (EC) with a force pin (P), a plunger (EB), a suitable elastic medium (M), a housing (C), an upper housing sealing ring (OC-1) and a lower housing sealing ring (OC-2); the lid (T), hollow, cylindrical in shape, staggered into an upper part of the lid (TS) and a lower part of the lid (TI), with the lid sealing ring (OT), of the o-ring type, between the upper part of the lid (TS) and the lower part of the lid (TI), with the upper part of the lid (TS) equipped with an external side channel (ROT), for fixing the base o-ring type sealing ring (OB), and a hole in the lid (OTE), circular in shape, passing, and aligned with the central segment of the shaft (ECC) of the shaft (E), and with the lower part of the lid (TI) in diameter smaller than the top part of the lid (TS), externally threaded and with internal vertical channels for fitting the upper part of the seat (ASS), and with an internal channel for fitting the locking ring (AT), in a U shape; the shaft (E), with the upper shaft segment (ES), cylindrical in shape, threaded and with the shaft through hole (OPE), with the central shaft segment (ECC), cylindrical, hollow and with a slightly larger diameter than the diameter of the upper shaft segment (ES), with the ringed shaft segment (EA), hollow, ring-shaped, around the central shaft segment (ECC), with a lateral channel (CLE), for fixation of the o-ring type shaft sealing ring (OE), and aligned with the guide hole (OGE), and with the lower segment of the shaft (EI), hollow and of prismatic shape with a hexagonal section to fit the guide (G); the guide (G), hollow, cylindrical in shape, stepped into an upper guide part (GS) and a lower guide part (GI), with the upper guide part (GS) having an outer circular channel (ROG), for fixing the guide sealing ring (OG), of the o-ring type, and a guide hole (OGE), passing, cylindrical in shape and aligned with the ring segment of the shaft (EA), and with the part lower part of the guide (GI) with a smaller diameter than that of the upper part (GS), externally threaded on the left, for threaded fitting with the upper part of the seat (ASS) and equipped with internal longitudinal channels for fitting the shaft (E); the seat (AS), hollow, stepped into a seat upper part (ASS) and a seat lower part (ASI), the seat upper part (ASS) externally of prismatic shape of hexagonal section, fitted into the lower part of the lid (TI), internally circular in shape, internally threaded on the left to thread the lower part of the guide (GI), and the lower part of the seat (ASI) in a cylindrical shape of small thickness; the temperature sensing device (EC) with the force pin (P), metallic, cylindrical in shape, aligned with the piston hole (OEB) and internally fitted to the lower segment of the shaft (EI); the plunger (EB), with the outer part (PEB), made of rubber or similar, in the shape of a ring and with sealing protrusions (SEB) around the center of the outer face, and with the inner part (IEB), metallic, of small thickness cylindrical shape, with the piston hole (OEB), through, circular in shape and aligned with the temperature sensing device (EC) and with the through holes (OPEB), circular, of small diameter and distributed radially; the appropriate elastic means (M), of the helical type and fitted to the lower part of the housing (CI) and the lower part of the piston (EB); the housing (C), hollow and of small thickness, with the upper part of the housing (CAS), cylindrical in shape, with internal thread for fixing the lower part of the lid (TI), with the upper external side channel (RC-1), for fitting the upper housing sealing ring (OC-1), of the o-ring type, with the lower external side channel (RC-2), for fitting the lower housing sealing ring (OC-2), o-ring type, with lower water flow holes (OIC) and upper water flow holes (OSC), through, circular, radially arranged and distributed on the lateral surface, and with the lower part of the housing (CI), hollow, with a prismatic shape with a hexagonal section on the outside and a circular shape on the inside; the connection between the device components is carried out as follows:

5*a*) The temperature sensing device (EC) with the force pin (P) is fitted into the plunger hole (OEB), with the force pin (P) facing upwards;

5*b*) The appropriate elastic medium (M) is placed inside the housing (C);

5*c*) The temperature sensing device (EC) with the force pin (P) and the plunger (EB) are placed on the appropriate elastic medium (M) inside the housing (C);

5*d*) The shaft sealing ring (OE) is fixed in the side channel (CLE) of the shaft ring segment (EA);

5*e*) The shaft (E) is assembled with the guide (G), with the lower segment of the shaft (EI) fitted into the channels in the lower part of the guide (GI);

5*f*) The guide sealing ring (OG) is fixed in the outer circular channel (ROG) of the guide (G);

5*g*) The assembly with the shaft (E) and guide (G) is fixed inside the lid (T) and secured with the locking ring (AT);

5*h*) The lid sealing ring (OT) is fixed between the top of the lid (TS) and the bottom of the lid (TI), and the base sealing ring (OB) is fixed in the outer side channel (ROT) of the lid (T);

5*i*) The seat (AS) is fixed to the guide (G) by the upper part of the seat (ASS) and fitted into the channels in the lower part of the lid (TI), with the internal threaded part of the upper seat (AS) being fitted with the external threaded part of the lower part of the guide (GI);

5*j*) The assembly with the temperature sensing device (EC), the force pin (P), the plunger (EB), the suitable elastic medium (M) and the housing (C), is joined with the assembly with the lid (T), shaft (E), guide (G) and seat (AS); and

5*k*) The housing sealing rings (OC-1) and (OC-2) are fixed in the two external side channels (RC-1) and (RC-2.

2. Water recirculation valve control device of the control process for reducing water waste in water heating systems, according to claim 1, characterized by, alternatively, the housing (C) and the lid (T) being replaced by the alternative housing (CA) and the alternative lid (TA), in that the alternative housing (CA) is hollow and of small thickness, with the upper part of the housing (CS), cylindrical in shape, with external side channels (RCA-1) and (RCA-2) for fitting the sealing rings of the housing (OC-1), (OC-2) and (OC-3) o-ring type, with lower water flow holes (OICA) and upper water flow holes (OSCA), through, circular, radially arranged and distributed on the lateral surface, and with the lower part of the housing (CAI), hollow, with a prismatic shape on the outside and a circular shape on the inside, with the external side channel (RCA-3) for housing the ring o-ring type housing seal; and the alternative lid (TA) is hollow, cylindrical in shape, equipped with a lid hole (OTAE), circular in shape, which is aligned with the central segment of the axis (ECC) of the axis (E), and being the part lower part of the lid (TAI) with a smaller diameter than the upper part of the lid (TAS), with internal vertical channels for fitting the upper part of the seat (ASS), and with an internal channel for fitting the locking ring (AT), in C format.

3. Operating process of the water recirculation valve control device of the control process for reducing cold water waste in water heating systems, according to claim 1 or 2, characterized by the following sequence of operations:

6*a*) With the recirculation valve (VR) in the closed position, there is no water flow from the hot water piping entering the lower part of the housing (CI) of the control device (DC), the guide (G) and the seat (AS) force the plunger (EB) onto the bottom of the upper part of the housing (CS), compressing the appropriate elastic medium (M);

6*b*) With the recirculation valve (VR) in the open position, the shaft (E), the temperature sensing device (EC) and the seat (AS) move, the appropriate elastic medium (M) expands and forces the piston (EB), still keeping it in contact with the seat (AS), preventing the flow of water from exiting through the upper water flow holes (OSC) of the housing (C) and the flow of cold or unheated water at the desired temperature (AF) enters through the lower part of the housing (C) and exits through the lower water flow holes (OIC) of the housing (C);

6*c*) With the tap open, the shaft (E) is activated, the temperature sensing device (EC) moves, the appropriate elastic medium (M) is compressed, the piston (EB) moves, touching the bottom of the housing (CS), moves away from the seat (AS), preventing the water flow from exiting through the lower water flow holes (OIC) of the housing (C), the flow of cold or unheated water at the desired temperature (AF) enters through the lower part of the housing (C) and exits through the upper water flow holes (OSC) of the housing (C) which are connected to the hot water consumption point and this flow drives the pressurization pump (BMB) of the water pipe hot (TQA);

6*d*) When the shaft (E) stops being driven, the appropriate elastic medium (M) expands, moving the piston (EB) and the temperature sensing device (EC), the piston (EB) moves away from the bottom of the housing (CS), rests against the seat (AS), preventing the flow of water through the upper water flow holes (OSC) of the housing (C), and the flow of cold or unheated water at the desired temperature (AF) returns exiting through the lower water flow holes (OIC) of the housing (C), which are connected to the cold water pipe, with water recirculating through the cold water pipe, due to the difference in pressure between it and the hot water pipe;

6*e*) With the water at the desired temperature, the temperature sensing device (EC) forces the force pin (P) against the shaft (E), compressing the appropriate elastic medium (M) and making the plunger (EB) move until contact the bottom of the housing (CI) and move away from the seat (AS), blocking the flow of hot water through the lower water flow holes (OIC) and directing the flow of hot water through the upper water flow holes (OSC) of the carcass (C); and 6*f*) When the user closes the recirculation valve (VR), the axis (E) moves the guide (G) and the guide (G) makes the seat (AS) move until the lower part of the seat (ASI) touches the plunger (EB), ceasing water flows, returning the control device (DC) to the condition described in item (6*a*).

4. Water recirculation valve of the control process for reducing water waste in water heating systems, in the configuration for a point of consumption with tap positioned with the handle vertically (axis (E) vertically), characterized by having the control device (DC) inserted into a sink base (BP), the axis (E) having its reach increased with the use of the axis adapter (AE), which is threaded onto the axis (E) and secured with the pin locking (PT) and have a sink base lid (TBP); the sink base lid (TBP) hollow, cylindrical in shape, stepped into a top sink lid (TBPS), externally threaded, and a bottom sink lid (TBPI), internally threaded and aligned with the nozzle (BB) from the base to the sink (BP); the shaft adapter (AE), with the upper segment (AES) in a cylindrical shape with grooves distributed radially on the external side, with the central segment (AEC) in a cylindrical shape and with the lower segment (AEI), threaded from the inside for fitting of the axis (E) and with two lateral oblong holes (REI) for the locking pin (PT) to pass through; the locking pin (PT), cylindrical in shape; the sink base (BP), with a base body (CB), cylindrical in shape, hollow, of small thickness, which serves as a housing for mounting the control device (DC), with a nozzle (BB), threaded externally, and with three externally threaded connections and diameters compatible with standard commercial fittings, with the connections being a water inlet (RA), a hot water outlet (SQ) and a cold water outlet (SF), the hot water (SQ) and the cold water outlet (SF) positioned on opposite sides of the base body (CB) and at different levels in relation to the base of the base body (CB), the hot water outlet (SQ) in upper position in relation to the cold water outlet (SF), the hot water outlet (SQ), aligned with the upper water flow holes (OSC) of the housing (C), with a hot water outlet hole (OQ) and the cold water outlet (SF), with a cold water outlet orifice (OF) and equipped with a snap-type cold water check valve (VAF), or similar.

5. Installation of the water recirculation valve of the control process to reduction water waste in water heating systems, in the configuration for a point of consumption with a tap positioned with the handle vertically (axis (E) vertically), according to claim 4, characterized by replacing the hot water valve in a mixer (MX) with the recirculation valve (VR); with the shaft adapter (AE) screwed onto the shaft (E) of the control device (DC) until its end reaches the necessary height so that the hot water knob is at the same height as the cold water knob; the shaft adapter (AE) held in position with the locking pin (PT) and secured to the base of the sink or washbasin with the accessory parts; the hot water outlet (SQ) of the sink base (BP) connected to the mixer (MX) and the cold water outlet (SF) of the sink base (BP) connected to the cold water pipe (TAF); the water inlet (RA) of the sink base (BP) connected to the hot water pipe (TAQ); the base of the cold water tap (RAF) has the inlet connected to the cold water pipe (TAF) and the cold water outlet (SF) from the base to the sink (BP) via the recirculation connection (LRA); the mixer output (MX) connected to the consumption point (PC).

6. Water recirculation valve of the control process for reducing water waste in water heating systems, in the configuration for a point of consumption with tap positioned with the handle horizontally (axis (E) horizontal), with the recirculation valve (VR), a mixer (MX) and the cold water valve (RAF) built into the wall, characterized by having the control device (DC) inserted into a shower tray (BC) with a shower tray lid (TBC) and the shaft (E) has its reach increased by using the shower shaft adapter (ACE), threaded onto the shaft (E) and secured with the locking pin (PT); the shower base lid (TBC) hollow, with the shower base lid (OTBC) hole and stepped into a shower tray lid (TBCS) top, cylindrical in shape and externally threaded, in a central part of the shower tray lid (TBCC), of prismatic shape with hexagonal section, and in a lower part of the shower tray lid (TBCI), of cylindrical shape, internally threaded and aligned with the main body of the shower tray (CBC); the shower shaft adapter (ACE), with the upper part (PAS) in a cylindrical shape with grooves distributed radially on the external side, with the central segment (PAC) in a cylindrical shape and with the lower segment (PAI), threaded from the inside and with side cavities (PAL) for the passage of the locking pin (PT); the shower base (BC), with a cylindrical, hollow and externally threaded main body of the shower base (CBC), which serves as a housing for mounting the control device (DC), with a central body of the base (CCBC) with three connections for water pipes of diameters compatible with standard commercial fittings and arranged in a "T" shaped structure, one being a connection for the shower's hot water inlet (CEQ), internally threaded and with a hot water inlet through hole (OCEQ), a shower hot water outlet connection (CSQ), externally threaded and with a hot water outlet through hole (OCSQ), and a recirculating cold water outlet (SFB), with a through hole for the hot water outlet (OSFB), with a shower cold water check valve, snap type or similar, inserted into the recirculation cold water outlet (SFB).

7. Installation of the water recirculation valve of the control process to reduction water waste in water heating systems in the configuration for a point of consumption with tap positioned with the handle horizontally (axis (E) horizontal), of according to claim 6, characterized by replacing the hot water valve in a mixer (MX) with the recirculation valve (VR); with the shaft adapter (ACE) screwed onto the shaft (E) of the control device (DC) until its end reaches the necessary height so that the hot water handle is at the same height as the cold water handle; the shaft adapter (ACE) held in position with the locking pin (PT); the hot water outlet (CSQ) of the shower tray (BC) connected to the mixer (MX) and the cold water outlet (CSF) of the shower tray (BC) connected to the cold water pipe (TAF); the water inlet (RA) of the shower tray (BC) connected to the hot water pipe (TAQ); the base of the cold water tap (RAF) has the inlet connected to the cold water pipe (TAF) and the cold water outlet (SF) of the shower base (BC) via the recirculation connection (LRA); the mixer output (MX) connected to the shower.

8. Control process control device for reduction of water waste in water heating systems for single-handle faucets, characterized by being equipped with a housing (CA), a lever support (SA), two pins (PI-1) and (PI-2), a lever (AL), a guide wire (AG), a limit switch (FC), a clip washer (ARP), a guide (DIR), a device temperature sensor (EC) with a force pin (P), a spacer washer (ARE), a divider (DIV), a divider seal ring (OVD), a seal (VED), a suitable elastic medium (MO) and a base (BA);

The housing (CM) has a stepped cylindrical shape and has an upper part (CMS), cylindrical with a circular through hole, a lower part (CMI), cylindrical, hollow and with a diameter larger than the upper part (CMS), with an internal section with thread (CMR) and two locking holes (OTL), rectangular and with guide relief;

The lever support (SA) has a cylindrical upper part (SAS), with a cross-shaped hole (OSA) and four circular pin holes (OPI), two on each face concentric with each other, one part lower (SAI), hexagonal in shape, with four oblong holes (OI) through, with an entrance (ESA), shaped like two staggered concentric circles and a rectangular hole through on its lower face;

The lever (AL), with a stepped prismatic shape, has a hole (OSAL) on its upper face and has two flaps (AAL) on its lower part, each flap (AAL) contains a lower hole (OIAL) that positions and retains the wire guide (AG);

The limit switch (FC), shaped like an oblong section with a hexagonal central hole, has a thread (RFC) on its rounded external sides, has an inlet in both parallel straight sections of the upper face and has a circular inlet (ECFC) partial on its lower face;

The director (DIR), with a hollow cylindrical shape, has an oblong hole (ODIR) through it, has two semicircular tabs (ADIR) that allow the limit switch (FC) to be fitted, and has a smooth upper face (FSDIR) that sits the clip washer (ARP) connected to the temperature sensing device (EC);

The clip washer (ARP), with a stepped cylindrical shape with a central hole (OARP), circular through hole and a central inlet (EARP) of larger diameter, on its lower face;

The divider (DIV), cylindrical in shape, has an upper face (FSDIV) that contains an oblong arched entrance (EADIV), contains a central hole (OCDIV) through and contains two sectioned holes (OSDIV), through, in circular segment format; has a lower face (FIDIV) that contains three cylindrical elongations (EDIV) with a hole (OEDIV) inside that meets the arched entrance (EADIV) of the upper face (FSDIV); has a channel (CDIV) on its side for seating the divider sealing ring (OVD); and The base (BA), cylindrical in shape, has two extrusions (EOBA) with an "eye" shaped section, has an extrusion (ECBA), with a section shaped like two tangent circles with a semicircle in its lower part, which contains a through circular hole (OLBA) and contains a through hole (OSBA) in the shape of a "half-moon", has two locks (TR) opposite each other and has a channel (CBA) on its side; in its inner part, it has three through holes (OIBA), partially obstructed by the extrusions (EOBA) and (ECBA), which accommodate the cylindrical elongations (EDIV) of the divider (DIV), it has a central circular inlet (EBA), which accommodates the appropriate elastic medium (M), and has a housing (ALB) that accommodates the seal (VED); the connection between the device components being carried out as follows:

9*a*) The lower part of the temperature sensing device (EC), with the force pin (P), is fitted and fixed in the hole in the spacer washer (OAR) and subsequently in the central hole of the divider (ODV), with the pin, force (P) facing upward;

9*b*) The upper part of the temperature sensing device (EC) is fitted through the central hole of the director (ODR) and then fitted and fixed in the hole of the clip washer (OAP);

9*c*) The suitable elastic medium (MO) is placed inside the base central inlet (EBA);

9*d*) The seal (VED) is positioned in the base housing (ALB);

9*e*) The divider sealing ring (OVD) is fitted to the divider side channel (CDIV);

9*f*) The temperature sensing device (EC) with the force pin (P), the washer (ARE), the divider (DIV), the director (DIR) and the clip washer (ARP) are placed on the elastic medium adequate (M) within the base (BA);

9*g*) The lever (AL) is fitted to the inside of the lever support (SA), being fixed by the pins (PI-1) and (PI-2);

9*h*) The guide wire (AG) is partially bent, positioned in the lower holes of the lever support (OI) coinciding with the lower holes of the lever (OIAL), and bent again to be positioned in the other holes (OI);

9*i*) The lever support (SA), together with the lever (AL) and the guide wire (AG), is fitted to the limit switch (FC), which in turn, is fitted to the internal cavity of the housing (CA); and

9*j*) The housing (CA), together with the lever (AL), lever support (SA), the pins (PI-1) and (PI-2), the guide wire (AG) and the limit switch (FC), is fixed to the base (BA), with the latches (TR-1) and (TR-2) fitted into the side locking holes (OTL-1) and (OTL-2), respectively.

9. Operating process of the control device of the control process for reducing cold water waste in water heating systems, according to the claim 8, characterized by the following sequence:

10*a*) With the tap in the closed position, there is no flow of water from the hot and cold water pipes, connected to the bottom of the tap, towards the water outlet, as, within the control device (DCM), the director (DIR) and divider (DIV) are positioned so as not to allow water to pass through;

10*b*) With the tap in the open position and in the hot water position (handle raised and turned to the left), the director (DIR) moves in relation to the divider (DIV), making the interconnection between the inlet orifice (OLBA) hot water, the cold water inlet orifice (OSBA) and the water outlet, however, if the water circulating through the control device (DCM) is not yet heated, the limit switch (FC) will be in the position upper part, the appropriate elastic means (M), which is supported on the base (BA), presses the assembly consisting of the divider (DIV), spacer washer (ARE), temperature sensing device (EC), director (DIR) and clip washer (ARP) until the latter touches the lever (AL) and opens a space between the base (BA) and the divider (DIV), however, due to the shape in the lower region and the decentralized position in relation to the main axis of the pin (PI-1), the lever is forced back to the closed position (tap handle lowered), thus preventing cold water from leaving the tap but at the same time recirculating the water from the hot water pipe into cold water direction, due to the space between the divider (DIV) and the base (BA);

10*c*) With the tap in the hot water position (handle turned to the left) and recirculation taking place, when the water circulating through the control device (DCM) heats up, the power pin (P) of the temperature sensing device (EC), which is against the pin (PI-2), presses the assembly composed of the divider (DIV), spacer washer (ARE), temperature sensing device (EC), director (DIR) and clip washer (ARP) until the divider (DIV) touches the base (BA), resting on the divider sealing ring (OVD), ending recirculation and allowing the lever to be moved to open the tap (handle remains in the raised position), due to the space created between the lever (AL) and the clip washer (ARP); and

10*d*) If the tap moves to the cold water position (handle turned to the right), regardless of the temperature of the water circulating in the control device (DCM), the limit switch (FC) moves the assembly formed by the divider (DIV), spacer washer (ARE), temperature sensing device (EC), director (DIR) and clip washer (ARP) until the divider (DIV) touches the base (BA), with seating on the divider sealing ring (OVD), ending recirculation and allowing cold water to flow out of the tap, if it is open (handle raised).

* * * * *